US008651633B2

(12) United States Patent
Marcus et al.

(10) Patent No.: US 8,651,633 B2
(45) Date of Patent: Feb. 18, 2014

(54) DROP PLACEMENT ERROR REDUCTION IN ELECTROSTATIC PRINTER

(75) Inventors: Michael A. Marcus, Honeoye Falls, NY (US); Hrishikesh V. Panchawagh, Rochester, NY (US); Shashishekar P. Adiga, Rochester, NY (US); Kam C. Ng, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/424,422

(22) Filed: Mar. 20, 2012

(65) Prior Publication Data

US 2013/0249983 A1 Sep. 26, 2013

(51) Int. Cl.
*B41J 2/07* (2006.01)

(52) U.S. Cl.
USPC ..... 347/74; 347/10; 347/78

(58) Field of Classification Search
USPC ..... 347/5, 9, 10, 73–83
See application file for complete search history.

(56) References Cited

U.S. PATENT DOCUMENTS

| | | | | |
|---|---|---|---|---|
| 3,373,437 | A | 3/1968 | Sweet et al. | |
| 3,596,275 | A | 7/1971 | Sweet | |
| 3,656,171 | A | 4/1972 | Robertson | |
| 3,827,057 | A | 7/1974 | Bischoff et al. | |
| 3,946,399 | A | 3/1976 | Zaretsky | |
| 4,054,882 | A | 10/1977 | Ruscitto | |
| 4,068,241 | A | 1/1978 | Yamada | |
| 4,613,871 | A | 9/1986 | Katerberg | |
| 6,273,559 | B1 | 8/2001 | Vago et al. | |
| 6,450,628 | B1 * | 9/2002 | Jeanmaire et al. | 347/75 |
| 6,746,108 | B1 * | 6/2004 | Jeanmaire | 347/82 |
| 7,192,121 | B2 | 3/2007 | Barbet et al. | |
| 7,712,879 | B2 | 5/2010 | Barbet | |
| 7,938,516 | B2 | 5/2011 | Piatt et al. | |

OTHER PUBLICATIONS

Lord Rayleigh, "On the Instability of Jets," *Proc. London Math.* Soc. X (1878).
Panchawagh, H. et al., U.S. Appl. No. 13/115,434, "Ejecting Liquid Using Drop Charge and Mass", filed May 25, 2011.
Panchawagh, H. et al., U.S. Appl. No. 13/115,465, "Liquid Ejection System Including Drop Velocity Modulation", filed May 25, 2011.
Panchawagh, H. et al., U.S. Appl. No. 13/115,482, "Liquid Ejection Method Using Drop Velocity Modulation", filed May 25, 2011.
Panchawagh, H. et al., U.S. Appl. No. 13/115,421, "Liquid Ejection Using Drop Charge and Mass", filed May 25, 2011.

* cited by examiner

*Primary Examiner* — Juanita D Jackson
(74) *Attorney, Agent, or Firm* — William R. Zimmerli

(57) ABSTRACT

A group timing delay device is provided to shift the timing of drop formation waveforms supplied to drop formation devices of nozzles of one of first and second groups so that print drops formed from nozzles of the first and second groups are not aligned relative to each other along a nozzle array direction. A charging device includes a common charge electrode associated with liquid jets formed from the nozzles of the first and second group and a source of varying electrical potential between the charge electrode and liquid jets. The source of varying electrical potential provides a charging waveform that is independent of print and non-print drop patterns. The charging device is synchronized with the drop formation device and the group timing delay device to produce a print drop charge state on print drops and a non-print drop charge state on non-print drops.

19 Claims, 27 Drawing Sheets

DROP PLACEMENT ERROR REDUCTION IN ELECTROSTATIC PRINTER

CROSS REFERENCE TO RELATED APPLICATIONS

Reference is made to commonly-assigned, U.S. patent application Ser. No. 13/115,434, entitled "EJECTING LIQUID USING DROP CHARGE AND MASS", Ser. No. 13/115,465, entitled "LIQUID EJECTION SYSTEM INCLUDING DROP VELOCITY MODULATION", Ser. No. 13/115,482, entitled "LIQUID EJECTION METHOD USING DROP VELOCITY MODULATION", and Ser. No. 13/115,421, entitled "LIQUID EJECTION USING DROP CHARGE AND MASS", the disclosures of which are incorporated by reference herein in their entirety.

Reference is also made to commonly-assigned, U.S. patent application Ser. No. 13,424,416, entitled "DROP PLACEMENT ERROR REDUCTION IN ELECTROSTATIC PRINTER", the disclosure of which is incorporated by reference herein in its entirety.

FIELD OF THE INVENTION

This invention relates generally to the field of digitally controlled printing systems, and in particular to continuous printing systems in which a liquid stream breaks into drops some of which are electrostatically deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface by using a pressurization actuator (thermal, piezoelectric, etc.). One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink may be perturbed in a manner such that the liquid jet breaks up into drops of ink in a predictable manner. Printing occurs through the selective deflecting and catching of undesired ink drops. Various approaches for selectively deflecting drops have been developed including the use of electrostatic deflection, air deflection and thermal deflection mechanisms.

One well-known problem with any type inkjet printer, whether drop-on-demand or continuous ink jet, relates to the accuracy of dot positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printed drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas.

In a first electrostatic deflection based CH approach, the liquid jet stream is perturbed in some fashion causing it to break up into uniformly sized drops at a nominally constant distance, the break-off length, from the nozzle. A charging electrode structure is positioned at the nominally constant break-off location so as to induce an input image data-dependent amount of electrical charge on the drop at the moment of break-off. The charged drops are then directed through a fixed electrostatic field region causing each droplet to deflect by an amount dependent upon its charge to mass ratio. The charge levels established at the break-off point cause drops to travel to a specific location on a recording medium or to a gutter, commonly called a catcher, for collection and recirculation. This approach is disclosed by R. Sweet in U.S. Pat. No. 3,596,275 issued Jul. 27, 1971, Sweet 275 hereinafter. The CIJ apparatus disclosed by Sweet '275 consisted of a single jet, i.e. a single drop generation liquid chamber and a single nozzle structure. A disclosure of a multi jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (linear array) of drop emitting nozzles each with its own charging electrode. This approach requires that each nozzle have its own charging electrode, with each of the individual electrodes being supplied with an electric waveform that depends on the image data to be printed.

One known problem with these conventional CIJ printers is variation in the charge on the print drops caused by image data-dependent electrostatic fields from neighboring charged drops in the vicinity of jet break off and electrostatic fields from adjacent electrodes associated with neighboring jets. These input image data dependent variations are referred as electrostatic cross talk. Katerberg disclosed a method to reduce the cross-talk interactions from neighboring charged drops by providing guard gutter drops between adjacent print drops from the same jet in U.S. Pat. No. 4,613,871. However, electrostatic cross talk from neighboring electrodes limits the minimum spacing between adjacent electrodes and therefore resolution of the printed image.

Thus, the requirement for individually addressable charge electrodes in traditional electrostatic. CIJ printers places limits on the fundamental nozzle spacing and therefore on the resolution of the printing system. A number of alternative methods have been disclosed to overcome the limitation on nozzle spacing by use of an array of individually addressable nozzles in a nozzle array and one or more common charge electrodes at constant potentials. This is accomplished by controlling the jet break off length as described by Vago et al. in U.S. Pat. No. 6,273,559 and by B. Barbet and P. Henon in U.S. Pat. No. 7,192,121. T. Yamada disclosed a method of printing using a charge electrode at constant potential based on drop volume in U.S. Pat. No. 4,068,241. B. Barbet in U.S. Pat. No. 7,712,879 disclosed an electrostatic charging and deflection mechanism based on break off length and drop size using common charge electrodes at constant potentials.

Other known problems with electrostatic deflection based CIJ printing systems include electrostatic interactions between adjacent drops which cause alterations of their in-flight paths and result in degraded print quality and drop registration. P. Ruscitto in U.S. Pat. No. 4,054,882 described a method of non sequential printing of ink drops issuing sequentially from a nozzle so that drops issuing sequentially from the nozzle are never printed adjacent to one another. This is done by applying multiple voltage states to deflection electrodes in sequence and requires different voltage state waveforms dependent on the image sequence to be printed. V. Bischoff et al. in U.S. Pat. No. 3,827,057 and J. Zaretsky in U.S. Pat. No. 3,946,399 described arrangements for compensating the charge to be applied to a drop being formed to correct for the effects of the charge on the drop which was just previously formed by altering the voltage applied during formation of the present drop.

High speed and high quality inkjet printing requires that closely spaced drops of relatively small volumes are accurately directed to the receiving medium. Since ink drops are usually charged there are drop to drop interactions between adjacent drops from adjacent nozzles in a CIJ printer. These interactions can adversely affect drop placement and print quality. In electrostatic based CU printer systems using high density nozzle arrays the main source of drop placement error on a receiver is due to electrostatic interactions between adjacent charged print drops.

As the pattern of drops traverse from the printhead to the receiving medium (throw distance), through an electrostatic deflection zone, the relative spacing between the drops progressively changes depending on the print drop pattern. When closely spaced print drops from adjacent nozzles are similarly charged while traveling in air, electrostatic interactions will cause the spacing of these adjacent neighboring print drops to increase as the print drops travel toward the receiving medium. This results in printing errors which are observed as a spreading of the intended printed liquid pattern in an outward direction and are termed "splay" errors or cross-track drop placement errors herein. Since splay errors increase with increasing throw distance it is required that the throw distance be as short as possible which adversely affects print margin denied as the separation between print drops and gutter drops.

As such, there is an ongoing need to provide a high print resolution continuous inkjet printing system that electrostatically deflects selected drops using an individually addressable nozzle array and a common charge electrode with reduced drop placement errors caused by electrostatic interactions having a simplified design, improved print image quality, or improved print margin.

SUMMARY OF THE INVENTION

It is an object of the invention to reduce drop placement errors in an electrostatic deflection based ink jet printer caused by electrostatic interactions between print drops. A second object of this invention is to increase the print margin defined as the separation between the print drop and gutter drop trajectories.

Image data dependent control of drop formation break off timing at each of the liquid jets in a nozzle array and a common charge electrode having image data independent time varying electrical potential, called a charge electrode waveform, are provided by the present invention. Drop formation is controlled to create sequences of one or more print drops and one or more non-print drops in response to the input image data. The nozzle array is made up of a plurality of nozzles being arranged into a first group and a second group of interleaved nozzles. A timing delay device is used to shift the drop formation waveforms supplied to the drop formation devices of the first group of nozzles relative to the drop formation waveforms supplied to the drop formation devices of the second group of nozzles. This causes print drops formed from nozzles of the first group and the print drops formed from nozzles of the second group to not be aligned relative to each other along the nozzle array direction. The charge electrode waveform and the drop formation waveforms are synchronized to produce a print drop charge state on the print drops and a non-print drop charge state on the non-print drops which is substantially different from the print drop charge state. A deflection device is then utilized to separate the paths of print and non-print drops followed by a catcher which intercepts non-print drops while allowing print drops to travel along a path towards a receiver.

The present invention improves CIJ printing by decreasing drop to drop electrostatic interactions, thus resulting in improved drop placement accuracy over previous CIJ printing systems. The present invention also reduces the complexity of control of signals sent to stimulation devices associated with nozzles of the nozzle array. This helps to reduce the complexity of charge electrode structures and increase spacing between the charge electrode structures and the nozzles. The present invention also allows for longer throw distances by lowering the electrostatic interactions between adjacent print drops.

According to one aspect of the invention, a method of printing includes providing liquid under pressure sufficient to eject liquid jets through a plurality of nozzles of a liquid chamber. The plurality of nozzles is disposed along a nozzle array direction. The plurality of nozzles is arranged into a first group and second group in which the nozzles of the first group and second group are interleaved such that a nozzle of the first group is positioned between adjacent nozzles of the second group and a nozzle of the second group is positioned between adjacent nozzles of the first group. A drop formation device is associated with each of the plurality of nozzles. Input image data is provided. Each of the drop formation devices is provided with a sequence of drop formation waveforms to modulate the liquid jets to selectively cause portions of the liquid jets to break off into streams of one or more print drops and one or more non-print drops in response to the input image data. A group timing delay device is provided to shift the timing of the drop formation waveforms supplied to the drop formation devices of nozzles of one of the first group and the second group so that the print drops formed from nozzles of the first group and the print drops formed from nozzles of the second group are not aligned relative to each other along the nozzle array direction. A charging device includes a common charge electrode associated with the liquid jets formed from both the nozzles of the first group and the nozzles of the second group and a source of varying electrical potential between the charge electrode and the liquid jet. The source of varying electrical potential provides a charging waveform that is independent of the print and non-print drop pattern. The charging device is synchronized with the drop formation device and the group timing delay device to produce a print drop charge state on the print drops and to produce a non-print drop charge state on the non-print drops which is substantially different from the print drop charge state. A deflection device causes drops having the print drop charge state and the non-print drop charge state to travel along different paths using the deflection device. A catcher intercepts non-print drops while allowing print drops to continue to travel along a path toward a receiver.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
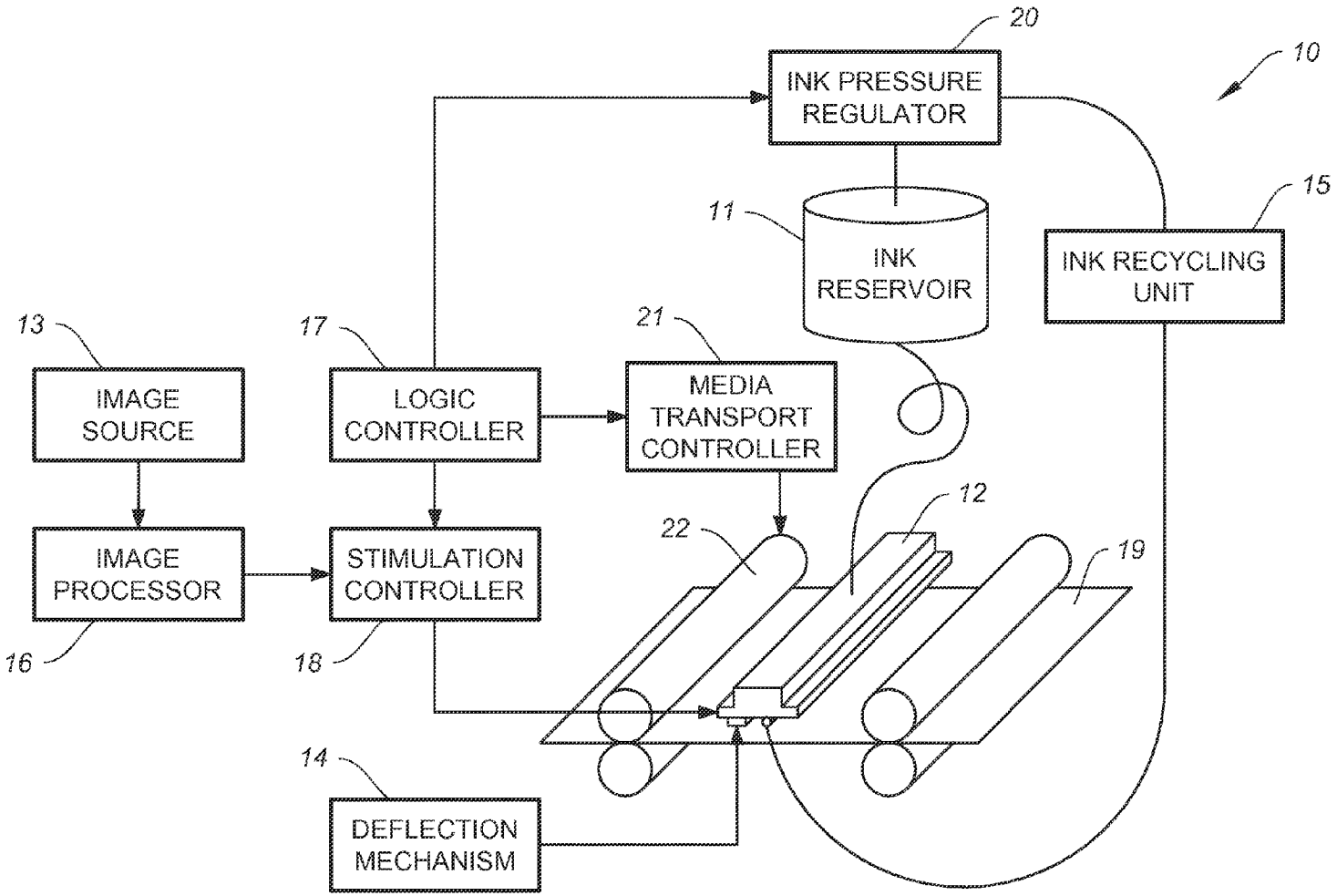
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of Jets," Proc. London Math. Soc. 10 (4), published in 1878. Lord Rayleigh's analysis showed that liquid under pressure, P, will stream out of a hole, the nozzle, forming a liquid jet of diameter $d_j$, moving at a velocity $v_j$. The jet diameter $d_j$ is approximately equal to the effective nozzle diameter $d_n$ and the jet velocity is proportional to the square root of the reservoir pressure P. Rayleigh's analysis showed that the jet will naturally break up into drops of varying sizes based on surface waves that have wavelengths $\lambda$ longer than $\pi d_j$, i.e. $\lambda \geq \pi d_j$. Rayleigh's analysis also showed that particular surface wavelengths would become dominate if initiated at a large enough magnitude, thereby "stimulating" the jet to produce mono-sized drops. Continuous ink jet (CIJ) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ the perturbation wavelength $\lambda$ is approximately equal to $4.5d_j$. The frequency at which the perturbation wavelength $\lambda$ is equal to $\pi d_j$ is called the Rayleigh cutoff frequency $F_R$, since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal may be manipulated to produce drops of various predetermined volumes. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, may be formed as the liquid stream necks down into a fine ligament of liquid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Drops of predetermined volume each have an associated portion of the drop forming waveform responsible for the creation of the drop. Satellite drops don't have a distinct portion of the waveform responsible for their creation. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-20 are described using particular combinations of components, for example, particular combinations of drop charging structures, drop deflection structures, drop catching structures, drop formation devices, also called stimulation devices, and drop velocity modulating devices. It should be understood that these combinations of components are interchangeable and that other combinations of these components are within the scope of the invention.

Figure 2:
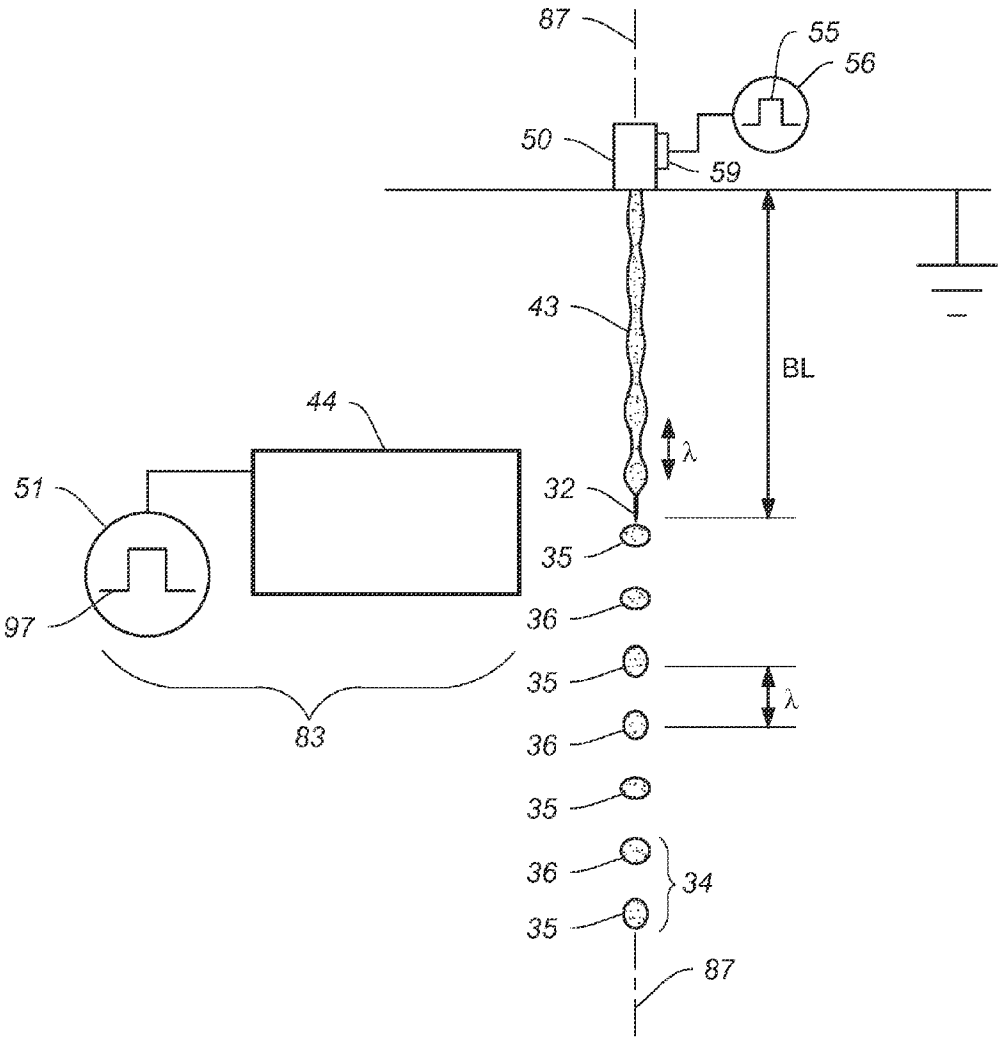
FIG. 2 shows an image of a liquid jet being ejected from a drop generator and its subsequent break off into drops at its fundamental period $\tau_o$ having a drop spacing $\lambda$.

A continuous inkjet printing system 10 as illustrated in FIGS. 1 and 2 comprises an ink reservoir 11 that continuously pumps ink into a printhead 12 also called a liquid ejector to create a continuous stream of ink 43 from each of the nozzles 50 of the liquid ejector 12. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP), which converts the received image data into print data, a bitmap of pixels for printing. The print data is sent to a stimulation controller 18, which generates stimulation waveforms 55; patterns of time-varying electrical stimulation pulses to cause a stream of drops to form at the outlet of each of the nozzles on printhead 12, as will be described. These stimulation pulses of the stimulation waveforms are applied to stimulation device(s) 59 associated with each of the nozzles 50 with appropriate amplitudes, duty cycles, and timings to cause drops 35 and 36 to break off from the continuous stream 43. The printhead 12 and deflection mechanism 14 work cooperatively in order to determine whether ink droplets are printed on a recording medium 19 in the appropriate position designated by the data in image memory or deflected and recycled via the ink recycling unit 15. The recording medium 19 is also called a receiver and it is commonly composed of paper. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20. Typical deflection mechanisms 14 include aerodynamic deflection and electrostatic deflection.

The RIP or other type of processor 16 converts the image data to a pixel-mapped image page image for printing. During printing, recording medium 19 is moved relative to printhead 12 typically by means of a plurality of transport rollers 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises one or more stimulation waveform sources 56 that generate drop formation waveforms in response to the print data and provide or applies the drop formation waveforms 55, also called stimulation waveforms, to the drop formation device(s) 59 associated with each nozzle 50 or liquid jet 43. In response to the energy pulses of applied stimulation waveforms, the drop formation device 59 perturbs the continuous liquid stream 43, also called a liquid jet 43, to cause individual liquid drops to break off from the liquid stream. The drops break off from the liquid jet 43 at a distance BL from the nozzle plate. The information in the image processor 16 thus can be said to represent a general source of data for drop formation, such as desired locations of ink droplets to be printed and identification of those droplets to be collected for recycling.

It should be appreciated that different mechanical configurations for receiver transport control can be used. For example, in the case of a page-width printhead, it is convenient to move recording medium 19 past a stationary printhead 12. On the other hand, in the case of a scanning-type printing system, it is more convenient to move a printhead along one axis (i.e., a main-scanning direction) and move the recording medium 19 along an orthogonal axis (i.e., a sub-scanning direction), in relative raster motion.

Drop forming pulses of the stimulation waveforms 55 are provided by the stimulation controller 18, and are typically voltage pulses sent to the drop formation devices 59 of the printhead 12 through electrical connectors, as is well-known in the art of signal transmission. However, other types of pulses, such as optical pulses, may also be sent to the drop formation devices 59 of printhead 12, to cause print and non-print drops to be formed at particular nozzles, as is well-known in the inkjet printing arts. Once formed, print drops travel through the air to a recording medium and later impinge on a particular pixel area of the recording medium and non-print drops are collected by a catcher as will be described.

Referring to FIG. 2 the printing system has associated with it, a printhead that is operable to produce from an array of nozzles 50 an array of liquid jets 43. Associated with each liquid jet 43 is a drop formation device 59 and a drop formation waveform source 56 that supplies a stimulation waveform 55, also called a drop formation waveform, to the drop formation transducer. The drop formation device 59, commonly called a drop formation transducer or a stimulation transducer, can be of any type suitable for creating a perturbation on the liquid jet, such as a thermal device, a piezoelectric device, a MEMS actuator, an electrohydrodynamic device, an optical device, an electrostrictive device, and combinations thereof.

The present invention illustrates various print drop selection schemes which utilize control of liquid jet break off timing. The first print drop selection scheme includes creation of a pair of drops at a drop pair period or a combined larger drop produced in the same drop pair period. In this first print drop selection scheme when a pair of drops is produced at the drop pair period one of them is printed, and when a combined larger drop is produced at the drop pair period, it is not printed. Thus, the maximum print drop frequency using the first print drop selection scheme is equal to the frequency for producing a drop pair or ½ the maximum recording medium speed. When utilizing the first print drop selection scheme, there is always at least one non-print drop before and after each successive print drop from any given nozzle in the array of nozzles. A second print drop selection scheme utilizes creation of drops of substantially the same volume produced at the fundamental drop formation frequency. When using the second print drop selection scheme, every drop can be printed and the maximum print frequency is equal to the fundamental drop formation frequency. Commonly-assigned, U.S. patent application Ser. No. 13/115,434, entitled "EJECTING LIQUID USING DROP CHARGE AND MASS", Ser. No. 13/115,465, entitled "LIQUID EJECTION SYSTEM INCLUDING DROP VELOCITY MODULATION", Ser. No. 13/115,482, entitled "LIQUID EJECTION METHOD USING DROP VELOCITY MODULATION", and Ser. No. 13/115,421, entitled "LIQUID EJECTION USING DROP CHARGE AND MASS" are suitable for use with the first print drop selection scheme and are incorporated by reference herein in their entirety. M. Piatt and R. Fagerquist in commonly assigned U.S. Pat. No. 7,938,516 disclosed an approach to produce selective charging and deflection of droplets formed at different phases (time) of a common charge electrode and is suitable for use with the second print drop selection scheme. U.S. Pat. No. 7,938,516 is incorporated by reference herein in its entirety.

It is to be noted that the present invention is not limited to utilizing these two print drop selection schemes and is applicable to any print drop selection schemes based on control of liquid jet break off timing. FIGS. 4-13 show various embodiments based on the first print drop selection scheme, and FIGS. 14-17 show various embodiments based on the second print drop selection scheme. The print period is defined as the minimum time interval between successive print drops coming from a single nozzle. A maximum of one print drop per nozzle can be printed during each print period. When utilizing the first print drop selection scheme the print period is equal to the drop pair period or $2\tau_o$, and when utilizing the second print drop selection scheme the print period is equal to the fundamental drop formation period $\tau_o$.

Figure 3:
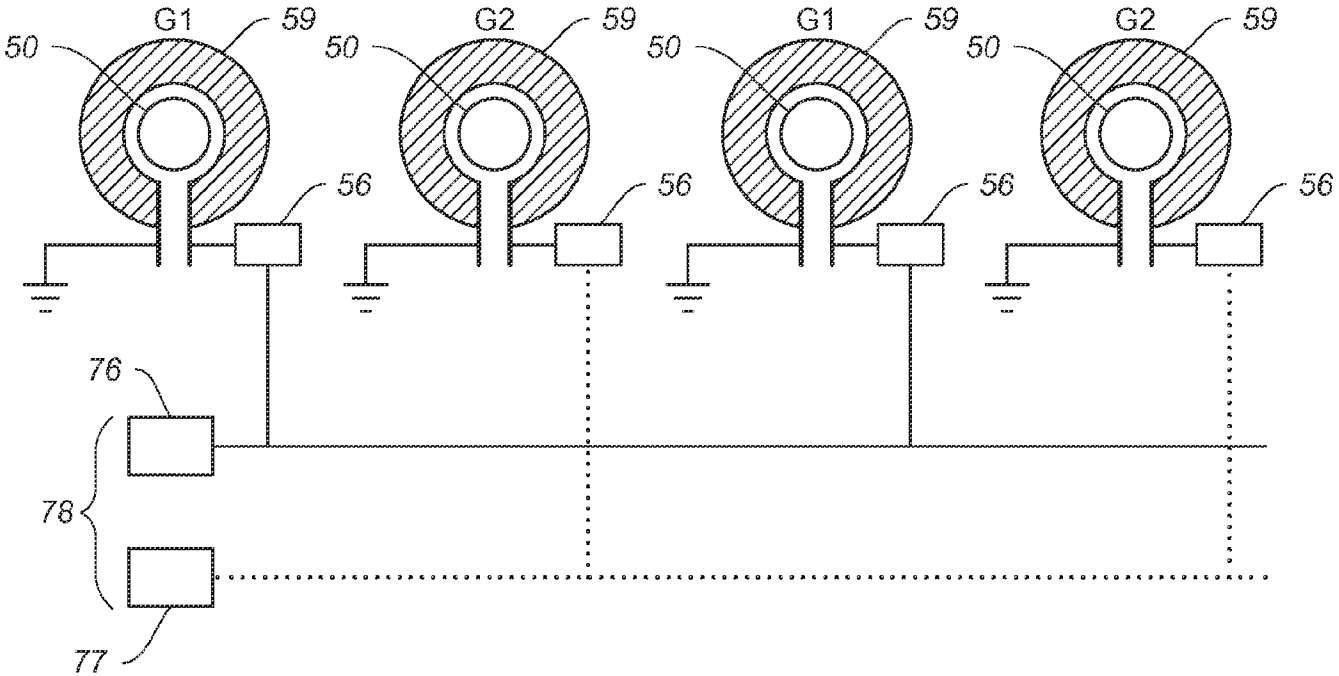
FIG. 3 is a simplified block schematic diagram of four adjacent nozzles arranged into two groups and associated jet stimulation devices according to one embodiment of the invention.

FIG. 3 shows an example of four adjacent nozzles 50 in a nozzle array, each with an associated drop formation device 59. In this example the drop formation devices 59 are thermally actuated and are composed of a resistive load driven by a voltage supplied by the stimulation waveform sources 56. Depending on the type of transducer used, the drop formation transducers can be located in or adjacent to the liquid chamber that supplies the liquid to the nozzles 50 to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source supplies a waveform having a fundamental frequency $f_o$ with a corresponding fundamental period of $\tau_o=1/f_o$ to the drop formation transducer, which produces a modulation with a wavelength $\lambda$ in the liquid jet. Fundamental frequency $f_o$ is typically close to $F_{opt}$ and always less than $F_R$. The modulation grows in amplitude to cause portions of the liquid jet break off into drops. Through the action of the drop formation device, a sequence of drops can be produced at a fundamental frequency $f_o$ with a fundamental period of $\tau_o=1/f_o$.

For a given drop formation fundamental period, the maximum recording medium speed or maximum print speed is defined as the speed at which every successive drop that breaks off from the jet being excited at the fundamental frequency $f_o$ can be printed with the desired drop separation determined by the print resolution settings. As an example, for a print head printing at a resolution of 600 by 600 dpi (drops per inch) operating at a fundamental frequency of $f_o$=400 kHz the maximum print speed is 16.93 m/s or 3333.33 ft/min. In general, the number of non-print drops formed in between successive print drops to print an all print condition is dependent on recording medium speed. As examples when printing every pixel at half maximum recording medium speed every other drop generated at the fundamental frequency $f_o$, will be printed and when printing every pixel at one fourth the maximum recording medium speed every fourth drop generated at the fundamental frequency $f_o$ will be printed.

In FIG. 2, liquid jet 43 breaks off into drops with a regular period at jet break off location 32, which is a distance BL from the nozzle 50. The distance between a pair of successive drops produced at the fundamental frequency labeled 35 and 36 in FIG. 2 is essentially equal to the wavelength of the perturbation on the liquid jet. This sequence of drops breaking from the liquid jet forms a series of drop pairs 34, comprised of a drop 35 and a drop 36. Each drop pair includes a first drop and a second drop one of which is a print drop and one of which is a non-print drop, and the terms first drop and second drop are not intended to indicate a time ordering of the creation of the drops in a drop pair. The frequency of formation of a drop pair 34 is commonly called the drop pair frequency $f_p$, is given by $f_p=f_o/2$ and the corresponding drop pair period is $\tau_p=2\tau_o$.

Figure 4:
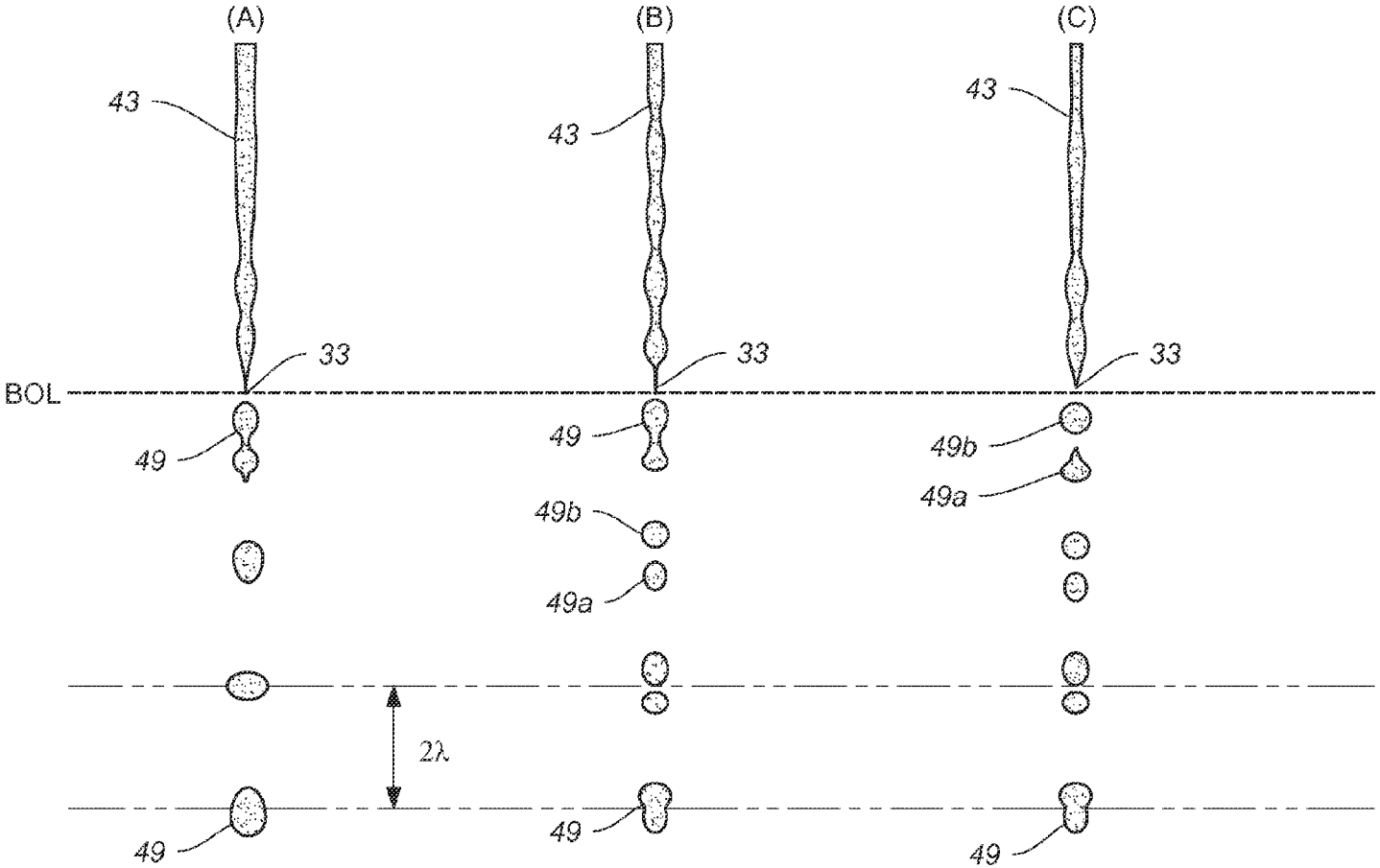
FIG. 4 shows images of a liquid jet being ejected from a drop generator at its subsequent break off into drops being generated at half the fundamental frequency with (A) showing pairs of drops breaking off as a single drop and staying combined, (B) showing pairs of drops breaking off as a single drop, separating and then recombining, and (C) showing drops breaking off individually with similar break off timing and then combining into a single drop.

Usually the drop stimulation frequency of the stimulation transducers for the entire array of nozzles 50 in a printhead is the same for all nozzles in the printhead 12. It is convenient to label the drops into drop pairs 34 when printing at less than or equal to half of the maximum recording medium speed. It is also convenient to generate larger non-print drops called large drops 49 as shown in FIG. 4 utilizing the first print drop selection scheme when printing at less than or equal to half of the maximum recording medium speed. As will be seen later, drops 35 and 36 are charged to different charge states in the practice of this invention and drops 35 are considered to be print drops and drops 36 are considered to be non-print drops when describing the various embodiments of this invention. When printing a succession of print drops at maximum recording medium speed every successive drop being formed will be printed, and the drops could not be considered to be formed in drop pairs 34 consisting of a print drop 35 and a non-print drop 36. In this case successive drops can include only print drops 35 or only non-print drops 36. Only print drops 35 and non-print drops 36 are generated without the use of large non-print drops 49 when printing at maximum recording medium speed utilizing the second print drop selection scheme.

The creation of the drops is associated with energy pulses supplied by the drop formation device operating at the fundamental frequency $f_o$ that creates drops having essentially the same volume separated by the distance $\lambda$. It is to be understood that although in the embodiment shown in FIG. 2, the first and second drops have essentially the same volume; the first and second drop may have different volumes such that pairs of first and second drops are generated on an average at the drop formation frequency. For example, the volume ratio of the first drop to the second drop can vary from approximately 4:3 to approximately 3:4. The stimulation for the liquid jet 43 in FIG. 2 is controlled independently by a drop formation transducer associated with the liquid jet or nozzle 50. In one embodiment, the drop formation transducer 59 comprises one or more resistive elements or heaters adjacent to the nozzle 50. In this embodiment, the liquid jet stimulation is accomplished by sending a periodic current pulse of arbitrary shape, supplied by the drop formation waveform source 56 through the resistive elements 59 surrounding each orifice of the drop generator.

The drop formation dynamics of drops forming from a liquid stream being jetted from an inkjet nozzle can be varied by altering the waveforms applied to the respective drop formation transducer associated with a particular nozzle orifice. Changing at least one of the amplitude, duty cycle or timing relative to other pulses in the waveform or in a sequence of waveforms can alter the drop formation dynamics of a particular nozzle orifice. It has been found that the drop forming pulses of the drop formation waveform can be adjusted to form a single larger drop also called a third drop or large drop 49 through several distinct modes as shown in FIG. 4. A segment of the jet that is two successive fundamental wavelengths long can break off as a single large drop 49 that stays together as shown in FIG. 4 (A); a segment of the jet that is two successive fundamental wavelengths long can break off as a single larger drop that then separates into two drops 49*a* and 49*b* and subsequently merge together again as shown in FIG. 4 (B); or a segment of the jet that is two successive fundamental wavelengths long can break off as two separate drops 49*a* and 49*b* which later merge into a larger drop 49 as shown in FIG. 4 (C). Drops 49*a* and 49*b* subsequently merge into larger drop 49 since their velocities at break off are different. The large drops 49 are produced at half the fundamental frequency and have an average spacing between adjacent large drops of $2\lambda$ and break off from the jet at the break off plane BOL at break off location 33 in FIG. 4. In the embodiments of this invention large drops 49 are not to be printed and are non-print drops.

In the practice of this invention, the drop formation waveforms 55, supplied to the drop formation transducer, that generate the large drops 49 are designed to produce break off lengths of the large drops (BOL) which are similar in length to the break off lengths (BL) of the smaller drops 35 and 36 shown in FIG. 2 so that both larger drops 49 and smaller drops 35 and 36 break off adjacent to the charge electrode 44. In the practice of this invention it is advantageous to generate large drops 49 when sequences of multiple non-print drops are required by the input image data. The large drops 49 are also called third drops or large non-print drops. Any pattern can be printed on the recording media 19 by controlling the jet break off timing to form print drops 35 or non-print drops 36 or large non-print drops 49.

FIG. 2 also shows a charging device 83 comprising charging electrode 44 and charging voltage source 51. The charging voltage source 51 supplies a charge electrode waveform 97 which controls the voltage signal applied to the charge electrode. The charge electrode 44 associated with the liquid jet is positioned adjacent to the break off location 32 of the liquid jet 43. If a non-zero voltage is applied to the charge electrode 44, an electric field is produced between the charge electrode and the electrically grounded liquid jet. The capacitive coupling between the charge electrode and the electrically grounded liquid jet induces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop. When the voltage level on the charge electrode is changed, the charge induced on the liquid jet changes due to the capacitive coupling between the charge electrode and the liquid jet. Hence, the charge on the newly formed drops can be controlled by varying the electric potential on the charge electrode.

The voltage on the charging electrode 44 is controlled by a charging voltage source 51 which provides a varying electrical potential in the form of a charge electrode waveform 97 between the charging electrode 44 and the liquid jet 43. In embodiments utilizing the first print drop selection scheme, the charge electrode waveform 97 is usually a two state waveform operating at the drop pair frequency equal to $f_P=f_o/2$, that is at half the fundamental frequency, or equivalently at a drop pair period $\tau_p=2\tau_o$, that is twice the fundamental period. The charge electrode waveform 97 includes a first distinct voltage state and a second distinct voltage state herein called the non-print drop voltage state and the print drop voltage state respectively, each voltage state usually being active for a time interval equal to the fundamental period when printing at less than or equal to half of the maximum recording medium speed. In embodiments utilizing the second print drop selection scheme, the charge electrode waveform is a two state waveform operating at the fundamental frequency $f_o$ or equivalently at the fundamental period $\tau_o$, and each voltage state is usually active for a time interval equal to half the fundamental period $\tau_o/2$.

The charge electrode waveform supplied to the charge electrode is independent of, or not responsive to, the image data to be printed. The charging device 83 is synchronized with the drop formation waveform source 56 so that a fixed phase relationship is maintained between the charge electrode waveform produced by the charging voltage source 51 and the clock of the drop formation waveform source. This occurs because the charge electrode waveform period is the same or an integer multiple of the period of the drop formation waveform applied to the drop formation transducer. This maintains the phase relationship between drop formation waveforms and the charge electrode waveforms even though the charge electrode waveform is independent of the image data supplied to the drop formation transducers. As a result, the phase of the break off of drops from the liquid stream, produced by the drop formation waveforms, is phase locked to the charge electrode waveform. For example, in embodiments utilizing the first print drop selection scheme, the drops 35 and 36 shown in FIG. 2 are generated one fundamental period $\tau_o$ apart in time so that they have different charge states. Print drops are formed while the charge electrode is in the print drop voltage state and non-print drops are formed while the charge electrode is in the non-print drop voltage state so that print drops 35 are charged to a print drop charge state and non-print drops 36 are charged to a non-print drop charge state also called a first non-print drop charge state. The first non-print drop charge state is distinct from the print drop charge state. Non-print drops 36 also have a first non-print drop charge to mass ratio and print drops 35 have a print drop charge to mass ratio.

When third drops (large drops 49) are generated as shown in FIG. 4 in which successive large drops are formed at twice the fundamental period $2\tau_o$ successive large drops will break off when the charge electrode is in the non-print drop voltage state. This results in the third drops being charged to a second non-print drop charge state. The second non-print charge state is also distinct from the print drop charge state. Consider a large drop 49 that is formed by a segment of the jet, which is two successive fundamental wavelengths long and which breaks off as a unit to form a single large drop (FIG. 4A) while the charge electrode is in the non-print drop voltage state. The charge induced on the segment of the liquid jet breaking off is related to the surface area of the segment, and on the electric field strength at the surface of the segment. As the surface area of the segment breaking off to form the large drop is about twice the surface area of a segment that breaks off to form the first drop of a drop, and the electric fields applied by the charge electrode are similar to those applied by the charge electrode to the first drop in the drop pair, the charge induced on the large drop as it breaks off is about twice the charge of the first drop in a drop pair. Since the large drop has a mass equal to about twice the mass of the first drop in the drop pair, the charge to mass ratio of the large drop formed by a segment of the jet, which is two successive fundamental wavelengths long, breaking off together a single large drop is therefore about equal to the charge to mass ratio state of the first charge to mass ratio state of drops 36. The charge to mass ratio of the large drop 49 formed by a segment of the jet, which is two successive fundamental wavelengths long, doesn't depend on whether the large drops separates into two drops that then coalesce (FIG. 4B) or stays together as one larger drop.

The waveforms that cause a segment of the jet that is two successive fundamental wavelengths long to break off as two separate drops with different initial velocities causing them to merge into a large drop shown in FIG. 4C can further be adjusted so that the break off phases of the two separate drops are close together (almost concurrent or separated in time by a small fraction (<25%) of a fundamental period). These drops will merge to form large drops and the two drops can be timed so that they both break off from the jet while the charge electrode is in the non-print drop voltage state. This results in the large drop formed by the merger of two separate drops to also be charged to the second non-print drop voltage state. The combined large drop formed from constituent drops having almost concurrent drop break offs has a third charge to mass ratio. The third charge to mass ratio state of large drops 49 is similar to the first charge to mass ratio state of drops 36. In all three examples of FIG. 4, the larger drops 49 are third drops that are charged to a second non-print charge state. It is also possible that when the drop formation waveform is adjusted or selected to cause the break off phases of the two drops of the drop pair to break off while the charge electrode is in the non-print drop voltage state such that the two drops never merge before they are deflected and guttered. These drops will each have approximately the same charge to mass ratio as other non-print drops. In other alternate print drop selection schemes, it is possible to use drop formation waveforms 55 to cause drops 49*a* and 49*b* to break off from liquid jet during two different charge electrode voltage states and therefore the two drops to have different charge states. Large drop 49 is created when the difference in the initial velocity of drops 49*a* and 49*b* causes them to merge having a different combined drop charge state.

FIG. 3 shows 4 adjacent nozzles 50 arranged into 2 groups and associated jet stimulation devices according to one embodiment of the invention. The nozzles are arranged into a first group G1 and a second group G2 in which the nozzles of the first group and second group are interleaved such that a nozzle of the first group is positioned between adjacent nozzles of the second group and a nozzle of the second group is positioned between adjacent nozzles of the first group. Thermal drop formation transducers 59 are composed of a resistive load surrounding the nozzles 50. The drop formation transducers 59 are driven by a voltage supplied by the stimulation waveform source 56. The stimulation waveforms consist of a sequence of drop formation waveforms of print drop and non-print drop stimulation waveform segments as shown in Section A of FIG. 5. In various embodiments of this invention utilizing the first print drop selection scheme there are three types of waveform segments utilized being print drop forming pulses 98, non-print drop forming pulses 99 and large drop forming pulses 94 (see FIG. 5 top trace). In this case, the stimulation waveforms are made up of a sequence of drop pair forming pulse trains. In embodiments utilizing the first print drop selection scheme, a maximum of one print drop can be produced in a time interval of $2\tau_o$ defined as a drop pair period. Drop formation waveform 55 pulses 94 generate large drops that break off adjacent to the charging electrode 44 while pulses 98 and 99 generate smaller print and non-print drops that break off adjacent to the charging electrode 44. The phase shift is set such that for each drop pair produced, the first drop breaks off from the jet while the charge electrode is in the print drop voltage state 96, yielding a print drop charge state on the first drop 35, and the second drop of the drop pair breaks off from the jet while the charge electrode is in the non-print drop voltage state 95, to produce a non-print drop charge state on the second drop 36 of the drop pair. The timing of pulses 94 in drop formation waveform 55 are controlled in order that the large drops break off when the charge electrode is in the non-print drop charge state. If the image data calls for a print drop then the drop pair forming pulse train consists of a print drop forming pulse 98 followed by a non-print drop forming pulse 99. If the image data calls for a non-print drop then the drop pair forming pulse train consists of large drop forming pulse 98. The first non-print drop charge state and second non-print drop charge state are similar and are distinct from the print drop charge state. This causes a differential deflection between print and non-print drops thus enabling non-print drops to be captured by a catcher and for print drops to be printed on the recording medium.

It has been found that it is desirable to increase the distance between adjacent print drops in adjacent nozzles in order to minimize electrostatic interactions between print drops which cause drop placement errors on the recording medium. In order to accomplish this, the plurality of nozzles are arranged into a first group and into a second group in which the nozzles of the first group and the second group are interleaved such that a nozzle of the first group is positioned between adjacent nozzles of the second group while a nozzle of the second group is positioned between adjacent nozzles of the first group, as shown in FIG. 3. A first group trigger 76 is applied to control the starting time of the stimulation waveforms to the first group of nozzles and a second group trigger 77 is applied that is delayed in time relative to the first group to control the starting time of the stimulation waveforms to the second group of nozzles. FIG. 3 shows a group timing delay device 78 comprising a first group trigger time delay 76 and a second group trigger time delay 77 which are simultaneously applied to each of the nozzles in their respective groups G1 and G2 to simultaneously trigger the start of the next drop pair forming pulse trains to each of the nozzles in their respective groups. Typically, each of the group trigger time delays 76 and 77 are distinct from each other and that they each enable print drops to break off during the print drop voltage state of the charge electrode waveform 97 and enable non-print drops to break off during the non-print drop voltage state of the charge electrode waveform 97 that is applied to the charge electrode 44. This puts limitations on the time delay difference $\Delta t_d$ between the first group time delay trigger 76 and the second group time delay trigger 77. For example, in embodiments utilizing the first print drop selection scheme, in order for requested print drops to be printed and non-print drops to not be printed requires that $\Delta t_d = \pm\delta\tau_o$, $2\tau_o \pm \delta\tau_o$, $4\tau_o \pm \delta\tau_o$, $6\tau_o \pm \delta\tau_o$ . . . where $\delta$ can be between 0 and 0.5. In embodiments utilizing the second print drop selection scheme, $\Delta t_d = \pm\kappa\tau_o$ where $\kappa$ is preferable between 0.10 and 0.45. Thus the group timing delay device 78 shifts the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction. In other embodiments, instead of using a dedicated timing delay device 78, the timing delay is inherent to the drop formation waveforms 55 supplied to the drop formation devices 56 of nozzles 50 of one of the first group or the second group so that the print drops formed from nozzles of the first group and the print drops formed from nozzles of the second group are not aligned relative to each other along the nozzle array direction. In further embodiments the timing delay can be achieved by shifting the input image data supplied to drop formation devices 56 associated with first and second nozzle groups to shift the timing of the drop formation waveforms 55 supplied to the drop formation devices of nozzles 50 of one of the first group or the second group so that the print drops formed from nozzles of the first group and the print drops formed from nozzles of the second group are not aligned relative to each other along the nozzle array direction.

Figure 5:
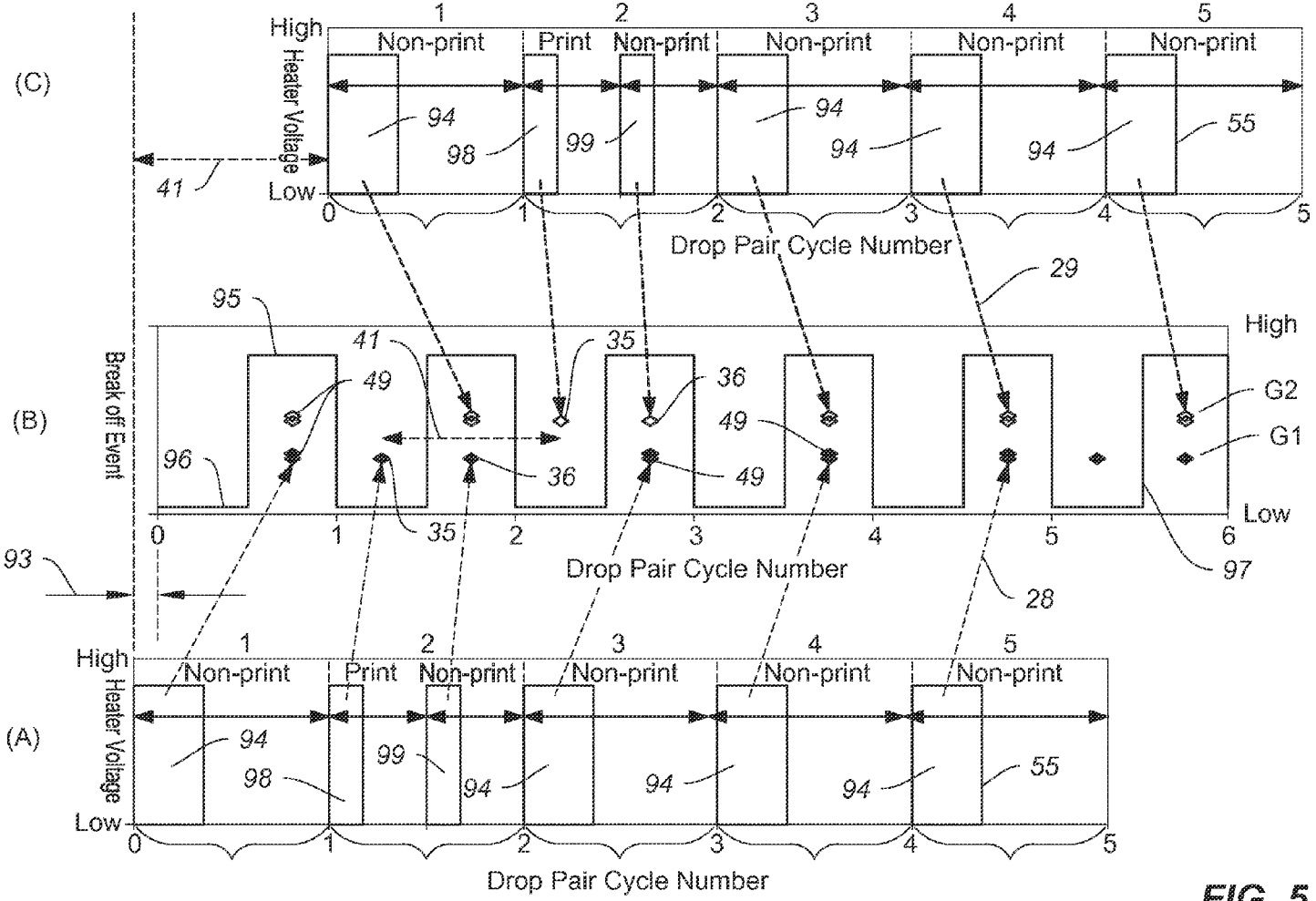
FIG. 5 shows a timing diagram illustrating drop formation pulses applied to a drop formation transducer for a nozzle in group 1 shown in (A) and for a nozzle in group 2 shown in (C) using the same drop formation pulse waveform sequence to produce a printing sequence containing one print drop in eight fundamental periods along with the charge electrode waveform, and the break off timing of drops for drops in group 1 (G1) and group 2 (G2) shown in (B)

FIG. 5 illustrates an embodiment of this invention utilizing the first print drop selection scheme in which the maximum print frequency is equal to drop pair frequency utilizing a nozzle array arranged into a first group G1 and a second group G2 in which the nozzles of the first group and second group are interleaved such that a nozzle of the first group is positioned between adjacent nozzles of the second group and a nozzle of the second group is positioned between adjacent nozzles of the first group. A timing diagram illustrating drop formation pulses applied to a drop formation transducer for a nozzle in group 1 is shown in (A) and for a nozzle in group 2 is shown in (C) using the same drop formation pulse waveform sequence to produce a printing sequence containing one print drop in eight fundamental periods. The break off timing of drops for drops in group 1 (G1) and group 2 (G2) along with the timing of the charge electrode waveform are shown in (B). The bottom section A of FIG. 5 shows a timing diagram illustrating a sequence of drop formation waveforms or heater voltage waveforms 55 as a function of time for a single nozzle of group 1 (G1) in a linear array of nozzles which are used to modulate a liquid jet to selectively cause portions of the liquid jet to break off into streams of one or more print drops and one or more non-print drops in response to the input image data. The drop formation waveforms are also called drop stimulation waveforms and are made up of individual drop formation pulses 94, 98 and 99 as shown. The top section C of FIG. 5 shows the same sequence of drop formation waveforms 55 as a function of time for a single nozzle of group 2 (G2) delayed in time by group time delay 41. The middle section B of FIG. 5 shows the common charge electrode voltage waveform as a function of time along with the break off timing of drops produced by the respective drop stimulation waveform pulses shown in sections A and C of FIG. 5 according to an embodiment of this invention. The drop formation pulses in FIG. 5 section A and section C are applied to the drop formation devices associated with each nozzle of Group 1 and Group 2 respectively of a nozzle array residing in a liquid chamber held at a pressure sufficient to eject liquid jets through the plurality of nozzles disposed along a nozzle array direction. The bottom section A and top section C of FIG. 5 shows the same sequence of drop formation waveform pulses (heater voltage waveforms 55 applied to thermal drop formation transducers 59) as a function of elapsed time for a single nozzle in different groups of a linear array of nozzles. The drop formation waveforms are applied to the liquid jet to modulate the liquid jets to selectively cause portions of the liquid jets to break off into streams of one or more print drops and one or more non-print drops in response to the input image data. The middle section B of FIG. 5 shows the break off timing of the drops 28 produced by the respective drop stimulation waveform pulses for a nozzle of group 1 (G1) shown in section A of FIG. 5 along with the break off timing of the drops 29 produced by the respective drop stimulation waveform pulses for a nozzle of group 2 (G2) shown in section C of FIG. 5. The middle section B of FIG. 5 also shows the common charge electrode voltage V as a function of time commonly called a charge electrode waveform 97. The horizontal time axis in both sections of FIG. 5 are labeled in drop pair time periods which is equal to twice the fundamental period of drop formation $2\tau_o$ for drops 35 and 36 or the time interval between successive large drops 49. The plots shown in FIG. 5 show a pair of drops being formed during drop pair cycle number 2 in which the first drop 35 is a print drop and will be printed on the recording medium and the second drop 36 is a non-print drop and will be intercepted by a catcher (not printed) while in drop pair cycle numbers 1, 3, 4, 5 large non-print drops 49 are formed which will all be intercepted by the catcher. The drop formation waveforms in the second drop pair cycle includes a drop forming pulse 98 followed by a non-print drop forming pulse 99 which result in the formation of the first drop 35 and the second drop 36 respectively with their break off timing shown in section B of FIG. 5. Drop forming pulses 94 shown in drop pair cycles 1, 3, 4, 5 form large drops 49 with their break off timing as shown. The middle section B of FIG. 5 includes the break off timing for the two groups of nozzles labeled G1 and G2 having a group time delay $\Delta t_d = 2\tau_o$ between the two groups indicated by double arrow 41 for the case in which every 1 out of 8 drops generated at the fundamental frequency and the same heater voltage waveforms being applied to both groups of nozzles. The group timing delay device 79 is utilized to produce the group time delay 41 applied to the second group of nozzles in this case. The group time delay 41 is equivalent to the difference between the times that the second group and the first group nozzles are triggered by the second group trigger 77 and the first group trigger 76. Generally, the timing delay device shifts the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction. Also, the two groups of nozzles are interleaved such that a nozzle of the first group is positioned between adjacent nozzles of the second group and a nozzle of the second group is positioned between adjacent nozzles of the first group.

Section A and section C of FIG. 5 show examples of a stimulation waveform 55 in which one print drop is generated in every eighth consecutive fundamental time period. The time axis is shown in terms of drop pair cycle time periods and the print drop is shown as the first drop in the second drop pair cycle's time period. The drop stimulation waveform 55 shown in drop pair cycle time periods 1 to 4 are repeated in order to continue to generate print one print drop in every eighth consecutive fundamental time period. Thus, the drop formation pulses in drop pair cycle number 5 are a repeat of the same drop formation pulses of drop pair cycle number 1. In this example, the stimulation waveform 55 is a heater voltage waveform timing diagram which shows the print drop being generated during the second drop pair cycle. The next print drop in group 1 nozzles would be generated during the sixth drop pair cycle and is shown in the Group 1 timing diagram for break off events (filled diamond) occurring in drop pair cycle number 6. In the example shown in section B of FIG. 5, the heater voltage pulses shown in section A and section C of FIG. 5 are applied to the nozzles of group G1 and group G2 respectively. The moment in time at which each drop breaks off from the liquid jet is denoted in section B as a filled diamond for group G1 nozzles and as an unfilled diamond for group G2 nozzles. Dashed arrows are drawn starting at the drop formation pulses which cause the break off of drops occurring during each drop pair time interval shown in sections A and C and ending at the corresponding break off events of the respective drops shown in section B. The short dashed arrows 28 indicate the group G1 break off event resulting from the corresponding drop formation pulses while the long dashed arrows 29 indicate the group G2 break event resulting from the corresponding drop formation pulse.

Section B of FIG. 5 also illustrates the charging voltage V as a function of time or the charge electrode waveform 97 supplied by the charging voltage source 51 to the charge electrode (44 or 45). The charge electrode waveform 97 shown is a 50% duty cycle square wave going from a high positive voltage state 95 to a low voltage state 96 with a period equal to the drop pair period, which is twice the fundamental period of drop formation so that one pair of drops 35 and 36 or one large drop 49 can be formed during one drop charging waveform cycle. The drop charging waveform for each drop pair time interval includes a non-print drop voltage state 95, and a print drop voltage state 96. The non-print drop voltage state corresponds to a higher voltage and the print drop voltage state corresponds to a lower voltage. The charge electrode waveform is supplied by a source of varying electrical potential between the charge electrode and the liquid jet. The charge electrode waveform 97 is also called the charging waveform and it is independent of the print and non-print drop pattern. Although FIG. 5 shows the charge electrode waveform 97 as having a 50% duty cycle square wave, other arbitrary charge electrode waveforms can be utilized with the present invention including square waves with duty cycles other than 50% or having multiple high and low level intervals within a charge electrode waveform period.

In order to practice this invention it is necessary to synchronize the common drop charging waveform applied to the charging device with the drop formation device and the group timing delay device in order to produce a print drop charge state on the print drops and to produce a non-print drop charge state on the non-print drops which is substantially different from the print drop charge state. A delay time 93 is used to cause a delay between the start of the first drop formation heater voltage pulse in each drop pair time interval and the start of each charge electrode waveform cycle in order to ensure proper synchronization. The timing of the starting phase of the charge electrode waveform 97 is adjusted to properly distinguish the charge level difference between the drops that are to print and those that are not to print. Ideally the delay time 93 between the trigger of a drop formation pulse train and the time at which the charge state time of the electrode is adjusted so that the drops will break off in center of a single charge state time interval of the electrode charge voltage waveform. Thus, the delay time 93 is used to synchronize the drop formation device with the electrode charging voltage source so as to maintain a fixed phase relationship between the charge electrode waveform and the drop formation waveform source clocks. A change in the delay time 93 by one half of the drop pair period would cause the print drops 35 to break off during the high voltage state 95 and drops 36 and large drops 49 to break off during the low voltage state. This is appropriate for the embodiment shown in FIG. 7A-7C.

FIG. 5 illustrates timing diagrams for an embodiment in which print drops are produced when the charge electrode voltage is in its low voltage state and non-print drops are produced when the charge electrode is in its high voltage state. In this case non-print drops are highly charged and not printed. For embodiments in which the highly charged drops are to be printed and less charged drops are to be caught, the starting phase of the charge electrode waveform 97 is phase shifted by adjusting the delay time 93 between the start of the first drop formation heater voltage pulse in each drop pair time interval and the start of the charging waveform cycle. As an example, when using the first print drop selection scheme, adding one fundamental period of drop formation to the delay time 93 will cause large drops 49 and non-print drops 36 to be in the low charge state at break off while print drops 35 will be in the high charge state for printing.

Figure 6A:
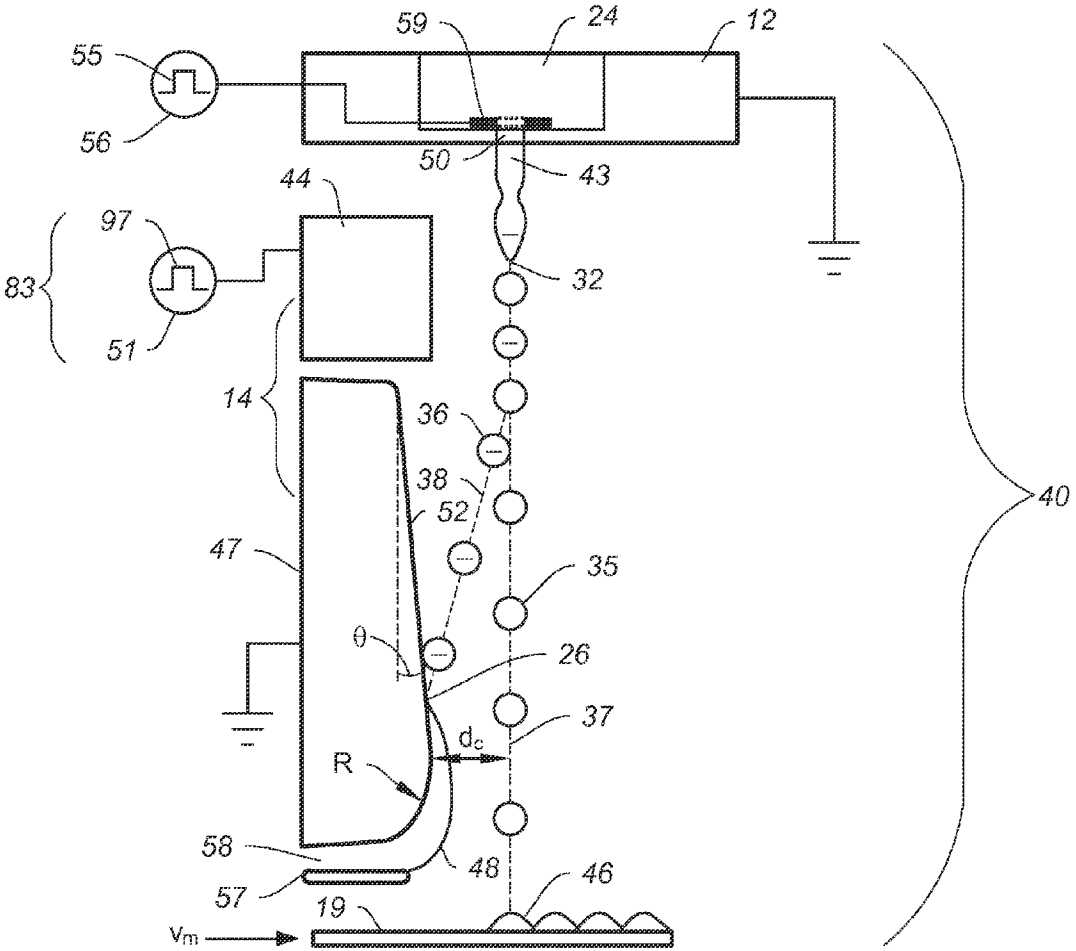
FIG. 6A shows a cross sectional viewpoint through a liquid jet of a first embodiment of the continuous liquid ejection system according to this invention operating in an all print condition.
Figure 6B:
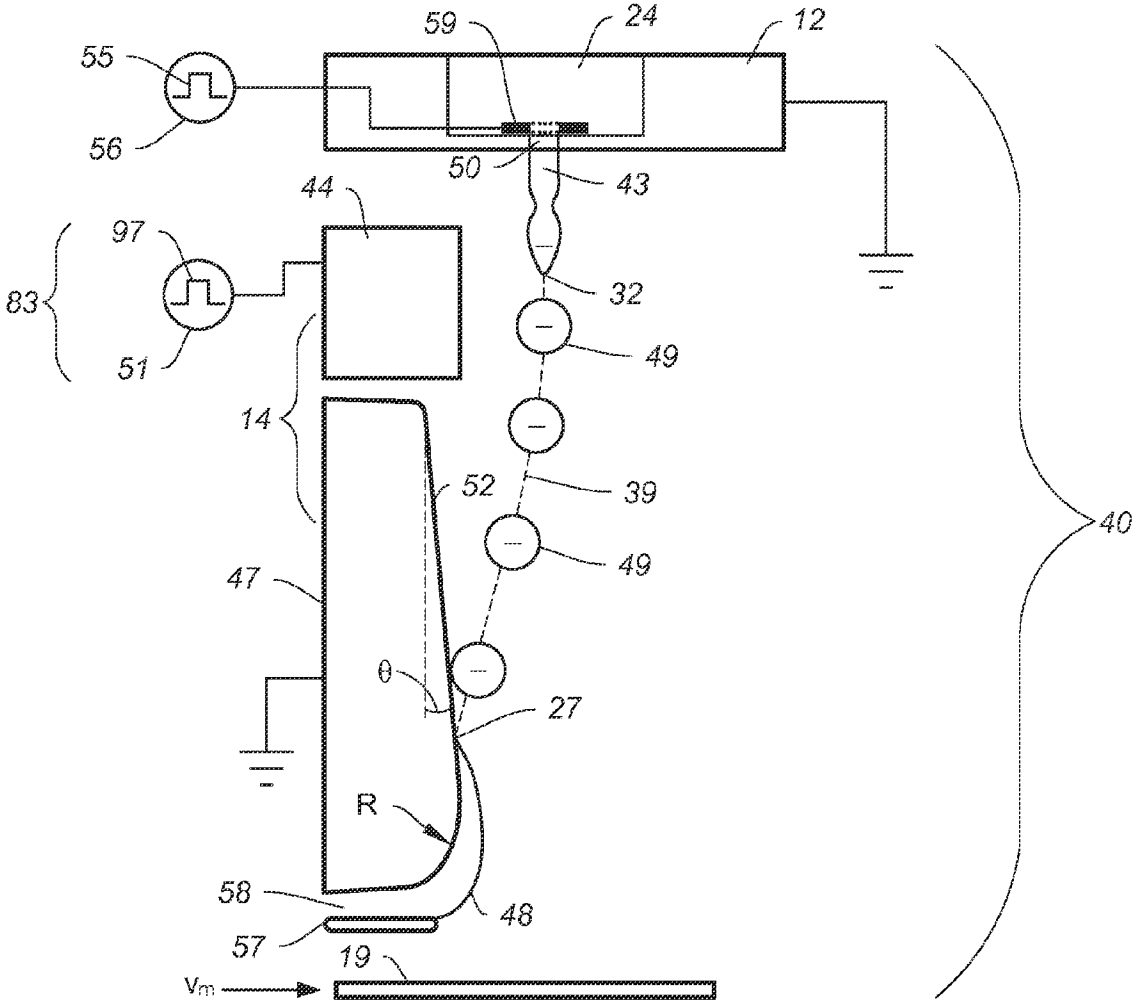
FIG. 6B shows a cross sectional viewpoint through a liquid jet of the first embodiment of the continuous liquid ejection system according to this invention operating in a no print condition.
Figure 6C:
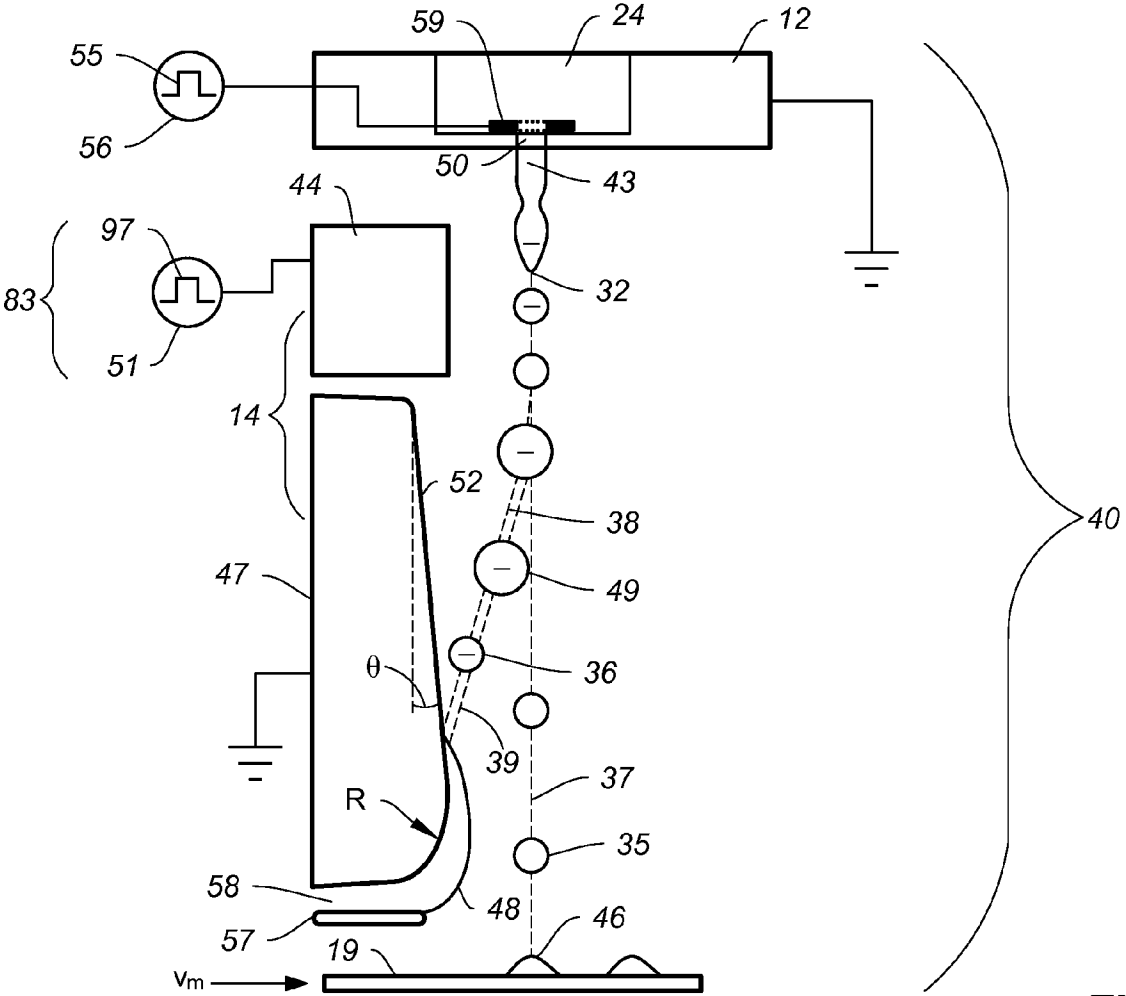
FIG. 6C shows a cross sectional viewpoint through a liquid jet of the first embodiment of the continuous liquid ejection system according to this invention operating in a general print condition.
Figure 7A:
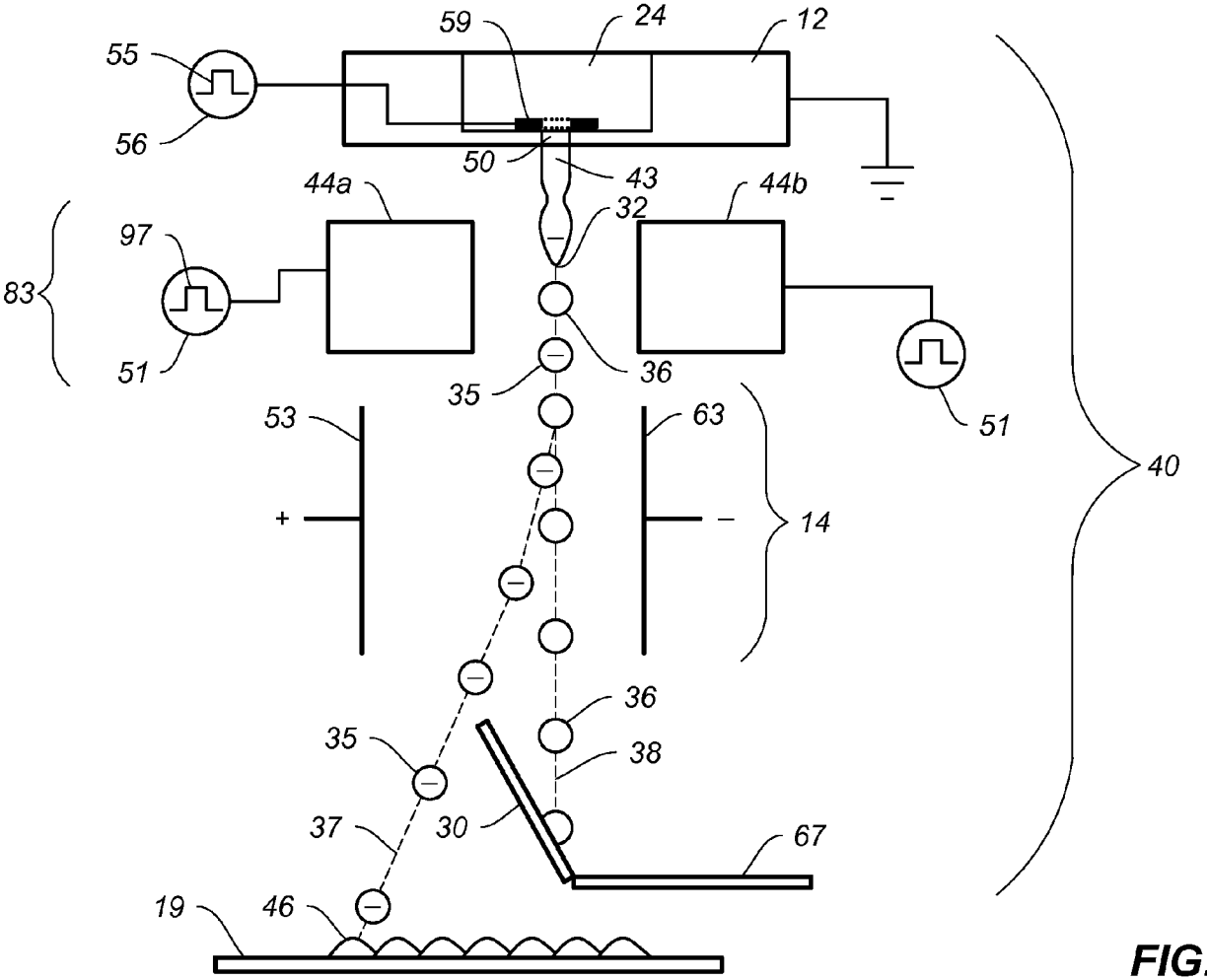
FIG. 7A shows a cross sectional viewpoint through a liquid jet of a second embodiment of the continuous liquid ejection system according to this invention in an all print condition.
Figure 7B:
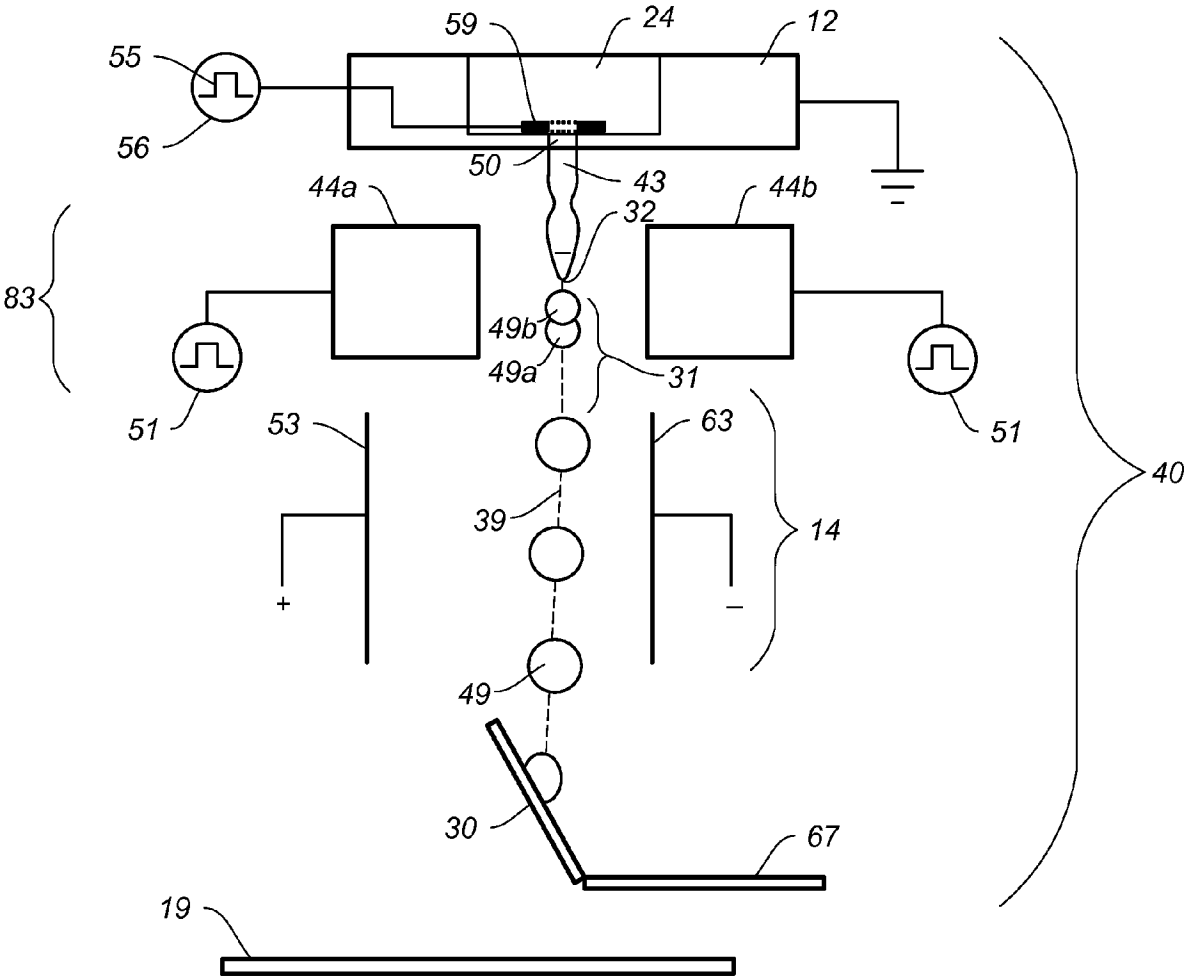
FIG. 7B shows a cross sectional viewpoint through a liquid jet of the second embodiment of the continuous liquid ejection system according to this invention operating in a no print condition.
Figure 7C:
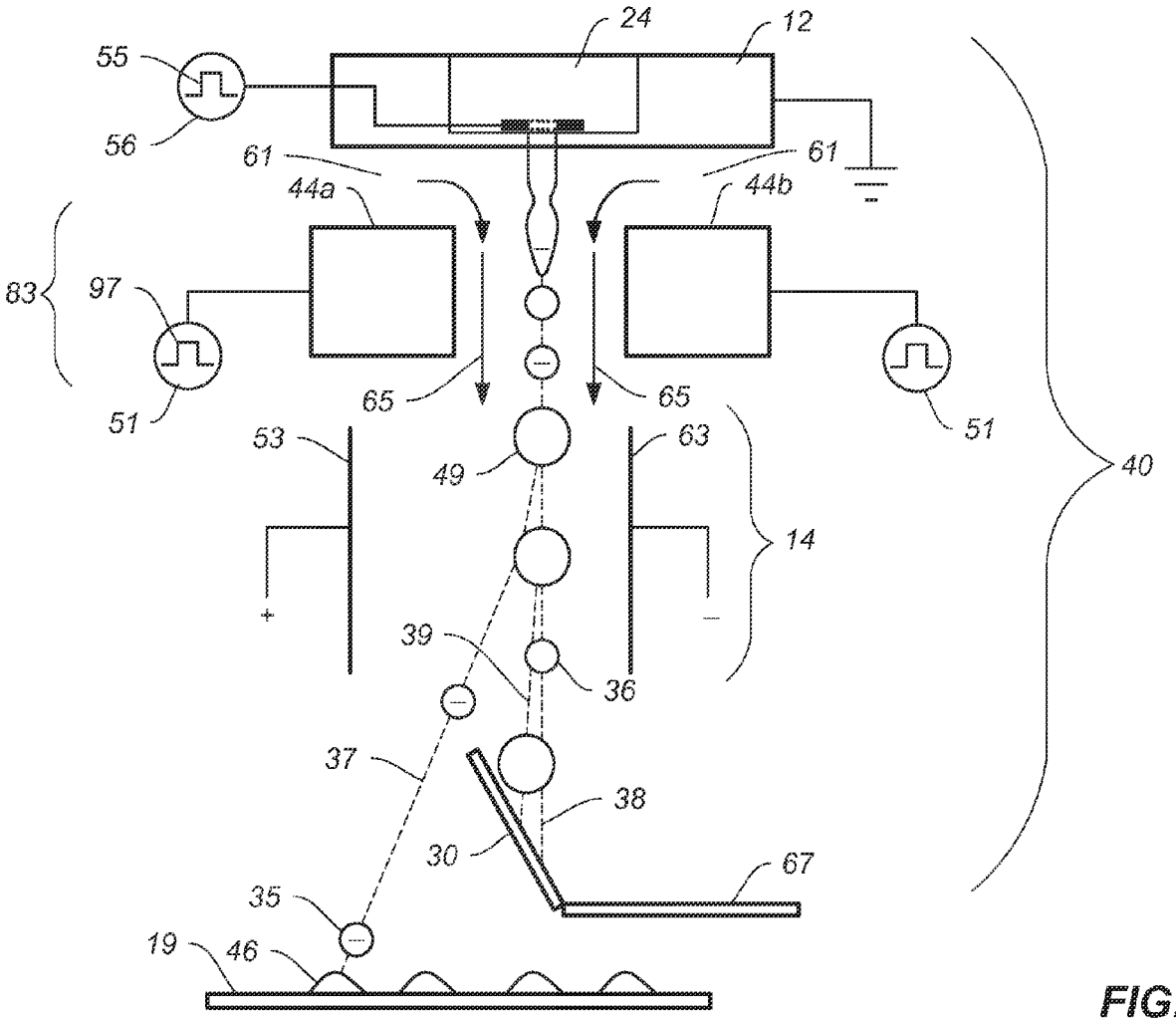
FIG. 7C shows a cross sectional viewpoint through a liquid jet of the second embodiment of the continuous liquid ejection system according to this invention illustrating a general print condition.
Figure 8A:
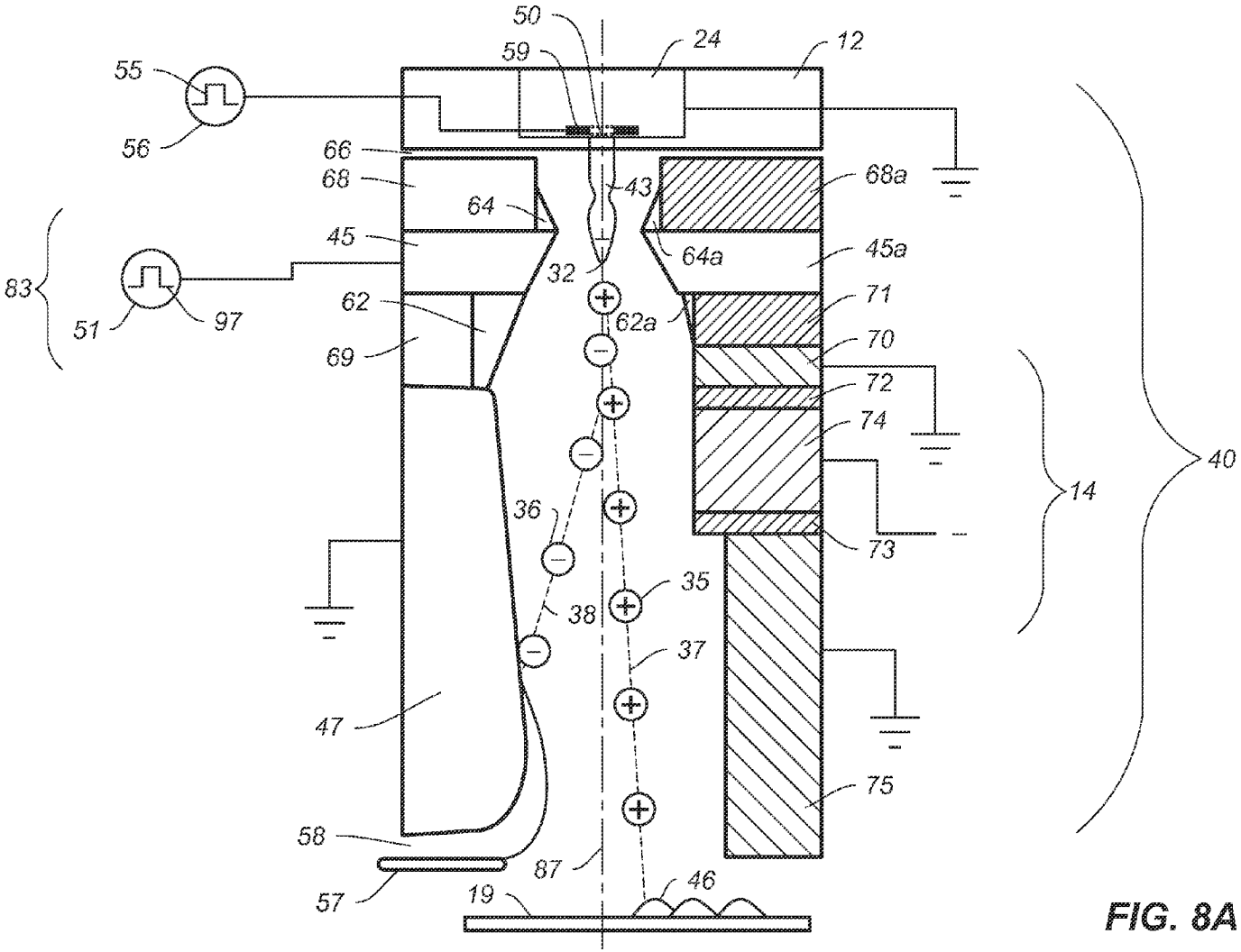
FIG. 8A shows a cross sectional viewpoint through a liquid jet of a third embodiment of the continuous liquid ejection system according to this invention in an all print condition.
Figure 8B:
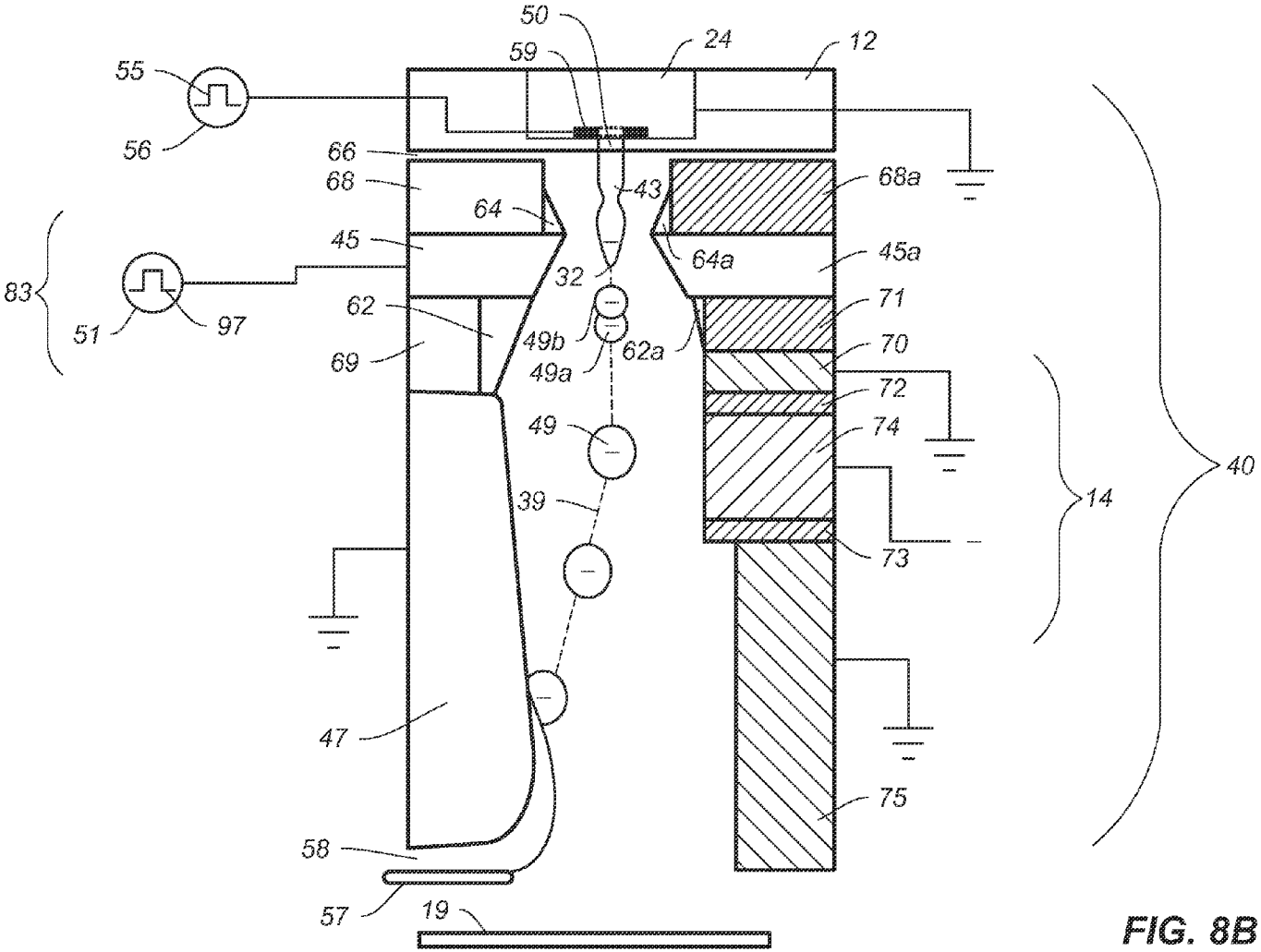
FIG. 8B shows a cross sectional viewpoint through a liquid jet of the third embodiment of the continuous liquid ejection system according to this invention in a no print condition.

FIGS. 6A-8B show various embodiments of a continuous liquid ejection system 40 used in the practice of this invention utilizing the first print drop selection scheme in which either pairs of drops 35 and 36, a single large drop 49 break off from the liquid jet 43 or a pair of print drops 35 break off from the liquid jet 43 during each drop pair period. FIGS. 6A-C show a first embodiment of the invention having a first hardware configuration utilizing the first print drop selection scheme while operating to produce different print patterns on the recording medium 19. FIGS. 7A-7C show a second embodiment of the invention having a second common hardware configuration utilizing the first print drop selection scheme while operating to produce different print patterns on the recording medium 19. FIGS. 8A-8B show a third embodiment of the invention having a third common hardware configuration utilizing the first print drop selection scheme while operating to produce different print patterns on the recording medium 19. FIGS. 6A, 7A and 8A show the various embodiments operating at half the maximum recording medium speed in all print conditions in which continuous sequences of pairs of drops 35 and 36 are produced at the fundamental frequency $f_o$ and every other drop formed is printed. The print condition shown in FIGS. 6A, 7A and 8A is defined as an all print condition in which every adjacent image pixel in the input image data is printed on the recording medium 19. Printed image pixels are equivalent to printed ink drops 46 shown on the top surface of recording medium 19. The all print condition is shown in the Figures as adjacent printed ink drops 46 being in contact with each other on the recording medium 19. As described above, the number of non-print drops formed in between successive print drops to print an all print condition is dependent on recording medium speed. When operating at half the maximum recording medium speed in an all print condition, every other drop formed at the fundamental frequency $f_o$ are printed. FIGS. 6B, 7B and 8B show the various embodiments in a no print mode in which continuous sequences of larger drops 49 are produced at the drop pair frequency with a mass approximately equal to the sum of the masses of drops 35 and 36 and none of the drops are printed. FIGS. 6C and 7C show general print conditions utilizing the first print drop selection scheme operating at less than or equal to half the maximum recording medium speed in which both pairs of drops 35 and 36 and larger drops 49 are produced during the drop pair periods in which drops 36 and larger drops 49 are not printed and drops 35 are printed.

In the various embodiments of the invention, the continuous liquid ejection system 40 includes a printhead 12 comprising a liquid chamber 24 in fluid communication with an array of one or more nozzles 50 for emitting liquid streams 43. Associated with each liquid jet is a stimulation transducer 59. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulation of the liquid jet 43 at the fundamental frequency $f_o$. In embodiments utilizing the first print drop selection scheme the periodic stimulation of the liquid jets 43 cause the jets to break off into sequences of drop pairs 34 spaced in time by the drop pair period $2\tau_o$ or sequences of larger drops 49 spaced in time by $2\tau_o$ and separated from each other by the distance $2\lambda$. Drops 35 are prints drops and drops 36 are non-print drops; a drop pair 34 is made up of a print drop 35 and a non-print drop 36. After drops break off adjacent to the charge electrode 44, the print drops 35 acquire a charge level called a first charge state, also called a print drop charge state, and travel along a first path 37 called the print drop path, and the non-print drops 36 acquire a charge level called a second charge state, also called a non-print drop charge state or a first non-print drop charge state, and travel along a second path 38 called the non-print drop path or the first non-print drop path. A catcher 47 or 67 is positioned to intercept and recycle non-print drops 36 traveling along the non-print drop path 38 while allowing print drops 37 travelling along the print drop path 37 to pass adjacent to the catcher and subsequently contacting the recording medium 19 while it is moving at a recording medium speed $v_m$. Print drops 35 are indicated as printed ink drops 46 shown as bumps on the recording medium 19. Also shown in FIGS. 6B-6C, FIGS. 7B-7C and FIG. 8B are larger third drops also called large drops 49. After large drops 49 break off adjacent to the charge electrode 44, the large drops 49 acquire a charge level called a third charge state, also called a large non-print drop state or second non-print drop charge state, and travel along a third path 39 called the large non-print drop path or the second non-print drop path. The catcher 47 or 67 is also positioned to intercept and recycle large non-print drops 49 traveling along the large non-print drop path 39.

In FIGS. 6A-6C and FIGS. 8A-B, the non-print drops 36 and larger non-print drops 49 are shown as possessing a negative charge. In an alternate embodiment, employing the opposite polarity of the two voltage states, the non-print drops could be positively charged rather than negatively charged. Although no charge is shown on the print drops 35 in these figures it has been found that they usually have a charge on them opposite in polarity to the non-print drops when the voltage between the charging electrode and the liquid jet is zero during the break off of the print drops. In FIGS. 7A-7B the print drops 35 are shown as possessing a negative charge while the non-print drops 36 and large non-print drops 49 are shown without any charge on them. In the embodiments shown in FIGS. 6A-6C, FIGS. 7A-7C and FIGS. 8A-B the non-print drops 36 and the large non-print drops 49 usually have a charge on them opposite in polarity to the print drops 35. Such opposite charge polarity on print drops and non-print drops can have a desirable effect on print window latitude because, under the action of the deflection device, the print drops travel along a path away from the catcher and non-print drops to travel along a different path towards the catcher where they are intercepted. This provides increased separation between print and non-print drops which allows non-print drops to be more readily intercepted by the catcher. However, when the print drops are charged, electrostatic interactions occur between nearby print drops which can cause errors in drop placement on the recording medium during printing. Once the trajectories of the print and non-print drops diverge, the repulsive electrostatic interactions between print drops can cause the outermost print drops to be repelled into the space vacated by the non-print drops. As a result, strokes of printed characters can be wider than intended and they can also include undesirable gaps between adjacent print drops. The degree to which this happens depends on the configuration and alignment of the drop charging and deflection components of the charge plate.

Associated with the liquid jet 43 is a drop formation device 59 and a stimulation waveform source 56 as shown in FIG. 2. The stimulation waveform source 56 provides a stimulation waveform 55 to the stimulation transducer 59 which creates a perturbation on the liquid jet 43 flowing through nozzle 50. The amplitude, duration, timing and number of energy pulses in stimulation waveform 55 determine how, where and when drops form, including the break off timing, location and size of the drops. The time interval between the break off of successive drops determines the size of the drops. Data from the stimulation controller 18 (shown in FIG. 1) is sent to the simulation waveform source 56 where it is converted to patterns of time varying voltage pulses to cause a stream of drops to form at the outlet of the nozzle 50. The specific drop stimulation waveforms 55 provided by the stimulation waveform source 56 to the stimulation transducer 59, examples of which are shown in sections A and C of FIG. 5, determine the break off timing of successive drops and the size of the drops. The drop stimulation waveforms are varied in response to the print or image data supplied by the image processor 16 to the stimulation controller 18. Thus the timing of the energy pulses applied to the stimulation transducers from the stimulation waveform depends on the print or image data. In order to print a print drop 46 on the recording medium while moving the print medium at less than or equal to half the maximum print speed, the waveform pulse sequence that is supplied to the stimulation transducer 59 is one that will produce a pair of drops separated in time on average by the fundamental frequency, one of which will be printed (see print drop forming pulse 98 and non-print drop forming pulse 99 in drop pair cycle 2 of section A of FIG. 5). When printing at half maximum print speed utilizing the first print drop selection scheme and the print data stream calls for a sequence of printed pixels, the sequence of waveforms supplied to the stimulation transducer produces a sequence of pairs of drops and the same drop of each drop pair of will be printed. In this case the same waveform pulse sequence of drop forming pulse 98 followed by non-print drop forming pulse 99 shown in drop pair cycle 2 of section A of FIG. 5 would be repeated. When the print data calls for a non-print drop and printing on the recording medium is being performed at less than or equal to half the maximum print speed, the waveform that is supplied to the stimulation transducer is one that will produce a large drop 49 using a pulse waveform such as 94 such as that shown in drop pair cycle 1 in section A of FIG. 5. When the print data calls for a sequence of non-print drops, the waveform that is supplied to the stimulation transducer is one that will produce a sequence of large drops such as that shown in drop pair cycle numbers 3, 4 and 5 of section A of FIG. 5. None of these large drops will be printed. Usually the sequence of waveforms that is created based on the print data stream comprises a sequence of waveforms selected from a set of predefined waveforms. The set of predefined waveforms includes one or more waveforms for the formation of pairs of drops 34 in one drop pair time period $2\tau_o$ where the drops of the drop pairs do not merge and one of them will be printed, and one or more waveforms for the creation of one large drop during a drop pair time period which will not be printed.

The embodiments shown in FIGS. 6A-8B show a continuous liquid ejection system 40 utilizing the first print drop selection scheme with particular various embodiments of charging devices 83 and deflection mechanism 14 included in the continuous liquid ejection system 40 described in detail herein. The continuous liquid ejection system 40 embodiments include components described with reference to the continuous inkjet system shown in FIG. 1. The continuous liquid ejection system 40 embodiments include liquid ejector or printhead 12 which includes a liquid chamber 24 in fluid communication with a nozzle 50 or nozzle array. (In these figures, the array of nozzles would extend into and out of the plane of the figure.) The liquid chamber 24 contains liquid under pressure sufficient to continuously eject liquid jets 43 through the nozzles 50. Each of the liquid jets has a drop formation device 59 and a drop formation waveform source 56. The drop formation waveform source 56 provides a stimulation waveform 55 operable to produce a modulation in the liquid jet to cause successive fundamental wavelength long portions of the liquid jet to break off into a series of drops 35 or drop pairs including a first drop 36 and a second drop 35 traveling along an initial path or a series of larger drops 49 traveling along the same initial path. The waveform provided by the waveform source 56 is adjusted, or waveforms are selected, so that either pairs of drops 35 and 36 or larger drops 49 are formed during each drop pair period or for a pair of drops 35 and 35 when printing at maximum recording medium speed. The continuous liquid ejection system also includes a charging device 83 including charge electrode 44, charge electrodes 44*a* and 44*b*, charge electrode 45 or charge electrodes 45 and 45*a* associated with the array of liquid jets and a source of varying electrical potential (charging voltage source 51) applied between the charge electrode and the liquid jets. When printing utilizing the first print drop selection scheme, the source of varying electrical potential 51 applies a charge electrode waveform 97 to the charge electrode having a period that is equal to the drop pair period $2\tau_o$. The charge electrode waveform is usually a two state waveform having first and second distinct voltage states called print and non-print drop voltage states, respectively, and the charging waveform applied to the charge electrode is independent of the print and non-print drop pattern as dictated by the input image data.

As discussed relative to the discussion of FIG. 2, the charge electrode 44 is positioned so that it is adjacent to the break off locations of the liquid jets in the nozzle array. The charging device is synchronized with the drop formation device so that the first voltage state or non-print drop voltage state 95 is active when non-print drop 36 of a drop pair breaks off adjacent to the electrode and the second voltage state or print drop voltage state 96 is active when print drop 35 of the drop pair breaks off adjacent to the electrode. As a result of the electric fields produced by the charge electrode in the print drop and non-print voltage states, a print drop charge to mass ratio state is produced on the print drop and a non-print drop charge to mass ratio state also called the first non-print drop charge to mass ratio state is produced on the non-print drop of each drop pair. The charging device is also synchronized with the drop formation device so that only the non-print voltage state is active when large drops 49 or closely spaced in time drops 49*a* and 49*b*, which break off closely in time and later combine into a single large drop 49, break off adjacent to the charge electrode 44. Thus, a third charge to mass ratio state also called a second non-print charge to mass ratio state is produced on the large drops 49. The second non-print drop charge to mass ratio state is similar to the first non-print drop charge to mass ratio states.

In the embodiment shown in FIGS. 6A-6C, the charge electrode 44 is part of the deflection device 14. When a voltage potential is applied to charge electrode 44 located to one side of the liquid jet adjacent to the break off point, the charge electrode 44 attracts the charged end of the jet prior to the break off of a drop, and also attracts the charged drops 36 and 49 after they break off from the liquid jet. This deflection mechanism has been described in J. A. Katerberg, "Drop charging and deflection using a planar charge plate", 4th International Congress on Advances in Non-Impact Printing Technologies. The catcher 47 also makes up a portion of the deflection device 14. As described in U.S. Pat. No. 3,656,171 by J. Robertson, charged drops passing in front of a conductive catcher face cause the surface charges on the conductive catcher face 52 to be redistributed in such a way that the charged drops are attracted to the catcher face 52.

In order to selectively print drops onto a substrate, catchers are utilized to intercept non-print drops which are then sent to the ink recycling unit 15. FIGS. 6A-6C, FIGS. 7A-C and FIGS. 8A-8B show embodiments in which the catcher 47 intercepts drops traveling along the non-print drop path 38 and the large non-print drop path 39 while drops traveling down the print drop path 37 are allowed to contact the recording medium 19 and be printed. In these embodiments, the first non-print drop charge state induced on the non-print drop of the drop pair, and the second non-print drop charge state induced on the large non-print drops are similar and distinct from the print drop charge state induced on the print drops of the drop pair. In the embodiments shown in FIGS. 6A-6E and FIGS. 8A-8B the first and second non-print drops are highly charged and deflected to be captured by the catcher and recycled while the print drops appear to have a relatively low charge and are shown as being relatively undeflected. In practice the print drops actually are deflected away from the catcher and allowed to hit the recording medium. FIGS. 7A-7C show an embodiment in which the print drops are highly charged and deflected away from a catcher 67 allowing the print drops to contact a recording medium and be printed. In this case the catcher 67 intercepts less charged non-print drops and large non-print drops traveling along the non-print drop path and the large non-print drop path respectively which are shown as being relatively undeflected.

In the embodiments shown in FIGS. 6A-6C and FIGS. 8A-8B a grounded catcher 47 is positioned below the charge electrode 44. The purpose of catcher 47 is to intercept or gutter charged drops so that they will not contact and be printed on print medium or substrate 19. The catcher also usually enables recycling of the ink that is not printed so that it can be jetted through the print head again. For proper operation of the printhead 12 shown in these figures the catcher 47 and/or the catcher bottom plate 57 are grounded to allow the charge on the intercepted drops to be dissipated as the ink flows down the catcher face 52 and enters the ink return channel 58. The catcher face 52 of the catcher 47 makes an angle θ with respect to the liquid jet axis 87 which is shown in FIG. 2. Charged drops 36 are attracted to catcher face 52 of grounded catcher 47 as are charged large drops 49. Drops 36 intercept the catcher face 52 at charged drop catcher contact location 26 and large drops 49 intercept the catch face 52 at charge large drop catcher contact location 27 to form an ink film 48 traveling down the face of the catcher 47. Catcher contact point 26 for non-print drops 36 is similar in height to catcher contact point 27 for large non-print drops 49 since the charge to mass ratio of both types of drops is similar. The bottom of the catcher has a curved surface of radius R, includes a bottom catcher plate 57 and an ink recovery channel 58 above the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet. If no voltage potential difference exists from the electrode 44 to the liquid jet 43 at the time of break off of a drop it would be expected that no charge will be induced on the forming drop that will be retained after break off of the drop from the liquid jet. However, as the second drop 35 breaking off from the liquid jet is capacitively coupled to the charged first drop 36, a charge can be induced on the second drop even when the charge electrode is at 0 V in the second charge state. It has been observed that the actual charge on the print drops 35 is close to the same as the magnitude of the charge on the non-print drops 36 and opposite in magnitude.

For simplicity in understanding the invention, FIGS. 6A-6C and FIGS. 8A-B are drawn showing little or no deflection of drops 35 as indicated by the direction of print drop path 37. For simplicity in understanding, the print drop path 37 is drawn to correspond with the liquid jet axis 87 shown in FIG. 2. The non-print drops of a drop pair 36 are in a high charge state so that the non-print drops 36 are deflected as they travel along the non-print drop path 38. This invention allows printing of one print drop during each drop formation time interval, at the drop generation fundamental frequency $f_o$ or at drop period $\tau_o$. This invention, when utilizing the first print drop selection scheme, allows for printing of one print drop per drop pair cycle, at the drop pair frequency $f_p=f_o/2$ or at drop pair period $\tau_p=2\tau_o$ in which case there is at least one non-print drop formed before or after every print drop.

FIGS. 7A-7C show a second embodiment of the continuous inkjet system according to this invention operating utilizing the first print drop selection scheme illustrating various print conditions. Shown are cross sectional viewpoints through a liquid jet of in which relatively non-deflected large drops 49 and relatively non-deflected non-print drops 36 are collected by catcher 67 while deflected print drops 35 are allowed to pass by the catcher and be printed on recording medium 19. FIG. 7A shows a sequence of drop pairs in an all print condition while printing at half the maximum recording medium speed, FIG. 7B shows a sequence of drop pairs in a no print condition while printing at less than or equal to half the maximum recording medium speed and FIG. 5C shows a normal print condition in which some of the drops are printed while printing at less than or equal to half the maximum recording medium speed. In FIG. 7B, large drops 49 are shown near break off as two separate drops 49*a* and 49*b* which may break off together and then separate and remerge into a single large drop 49. Drops 49*a* and 49*b* may also break off separately as two drops at nearly the same time and then merge into a single large drop. As shown in FIG. 7A, the charging voltage source 51 may deliver a repetitive charge electrode waveform 97 at the drop pair frequency of drop formation so that the first drop 36 of a sequential pair of drops is charged by charge electrode 44 to a first charge state and the second drop 35 of the drop pair is charged to a second charge state by the charge electrode 44*a* and 44*b*.

In the embodiment shown in FIGS. 7A-7C, the charge electrode 44 includes a first portion 44*a* and a second portion 44*b* positioned on opposite sides of the liquid jet, with the liquid jets breaking off between the two portions of the charge electrode. Typically, the first portion 44*a* and second portion 44*b* of charge electrode 44 are either separate and distinct electrodes or separate portions of the same device. The electrode may be constructed out of a single conductive material with a parallel gap being machined between the two halves. The left and right portions of the charge electrode are biased to the same potential by the charging voltage source 51. The addition of the second charge electrode portion 44*b* on the opposite side of the liquid jet from the first portion 44*a*, biased to the same potential, produces a region between the charging electrode portions 44*a* and 44*b* with an electric field that is almost symmetric left to right about the center of the jet. As a result, the charging of drops breaking off from the liquid jet between the electrodes is very insensitive to small changes in the lateral position of the jet. The near symmetry of the electric field about the liquid jet allows drops to be charged without applying significant lateral deflection forces on the drops near break-off. In this embodiment, the deflection mechanism 14 includes a pair of deflection electrodes 53 and 63 located below the charging electrode 44*a* and 44*b* and below the merge point 31 of drops 49*a* and 49*b* into a single large drop 49. The electrical potential between these two electrodes is shown to produce an electric field between the electrodes that deflects negatively charged drops to the left. The strength of the drop deflecting electric field depends on the spacing between these two electrodes and the voltage between them. In this embodiment, the deflection electrode 53 is positively biased, and the deflection electrode 63 is negatively biased. By biasing these two electrodes in opposite polarities relative to the grounded liquid jet, it is possible to increase the separation between print drops 35 and non-print drops 36 and large non-print drops 49.

In the embodiment shown in FIGS. 7A-7C, a knife edge catcher 67 has been used to intercept the non-print drop trajectories. Catcher 67, which includes a catcher ledge 30, is located below the pair of deflection electrodes 53 and 63. The catcher 67 and catcher ledge 30 are oriented such that the catcher intercepts drops traveling along the non-print drop path 38 for non-print drops 36 and also intercepts large drops 49 traveling along the large non-print drop path 39 as shown in FIG. 7B, but does not intercept charged print drops 35 traveling along the print drop path 37. Preferably, the catcher is positioned so that the drops striking the catcher strike the sloped surface of the catcher ledge 30 to minimize splash on impact. The charged print drops 35 are printed on the recording medium 19.

For the discussion below relating to FIGS. 7A-7C, the charging voltage source 51 is assumed to deliver approximately a 50% duty cycle square wave waveform at half the fundamental frequency of drop formation. When electrode 44*a* and 44*b* has a positive potential on it a negative charge will develop on drop 35 as it breaks off from the grounded jet 43. When the voltage is switched to a low voltage on electrode 44 during formation of drop 36 there will a positive charge is induced on drop 35 as it breaks off from the grounded jet 43 due to capacitive coupling with the negatively charged preceding drop. A positive potential is placed on deflection electrode 53 which will further attract negatively charged drops 35 towards the plane of the deflection electrode 53. Placing a negative voltage on deflection electrode 63 will repel the negatively charged drops 35 from deflection electrode 63 which will tend to aid in the deflection of drops 35 toward deflection electrode 53. The fields produced by the applied voltages on the deflection electrodes will provide sufficient forces to the drops 35 so that they can deflect enough to miss the gutter ledge 30 and be printed on recording medium 19. Similarly the slightly positively charged drops 36 will be attracted towards deflection electrode 63 which will aid in capturing the drops 36 by catcher 67. In order for the configuration shown in FIGS. 7A-7C to function properly, the phase of the two state waveform 97 must be approximately 180 degrees out of phase with the 2 state waveform 97 utilized in the configuration shown in FIGS. 6A-6C. For the FIGS. 7A-7C configurations non-print drops 36 and large non-print drops 49 have distinct charge states that are distinct from the charge state on print drops 35.

FIG. 7C shows a normal print sequence in which drop pairs 35 and 36 are generated along with some larger drops 49. Charged drops 35 are printed as printed ink drops 46 onto moving recording media 19 and non-print drops 36 and non-print large drops 49 are caught by catcher 67 and not printed. The pattern of printed ink drops 46 would correspond to image data from the image source 13 as described with reference to the discussion of FIG. 1. In the embodiment shown in FIG. 7C, an optional air plenum 61 is formed between the charge electrode and the nozzle plate of the geometry. Air, supplied to the air plenum by an air source (not shown), surrounds the liquid jet and stream of drops as they pass between the first and second portions of the charge electrode, 44*a* and 44*b* respectively, as indicated by arrows 65. This air flow moving roughly parallel to the initial drop trajectories helps to reduce air drag effects on the drops that can produce drop placement errors.

FIGS. 8A-8B show cross sectional viewpoints through a liquid jet of a third embodiment of a continuous inkjet system utilizing the first print drop selection scheme according to this invention having an integrated electrode and gutter design. FIG. 8A illustrates a sequence of drop pairs in an all print condition operating at half maximum recording medium speed and FIG. 8B illustrates a sequence of drop pairs in a no print condition operating at half maximum print speed or lower. The print drops 35 in FIG. 8A are shown as having a positive charge while the non-print drops 36 are shown as having a negative charge. Therefore they are deflected away from the catcher and shown as being deflected to the right relative to the liquid jet axis 87.

All of the components shown on the right side of the jet 43 in FIGS. 8A-8B are optional and make up a third alternate embodiment of this invention. Insulator 68 and optional insulator 68*a* are adhered to the top surfaces of charge electrode 45 and optional second charge electrode portion 45*a* respectively and act as insulating spacers to ensure that the printhead is electrically isolated from the charge electrode(s) 45 and 45*a* and that the charge electrode 45 and optional charge electrode 45*a* are located adjacent to the break off location 32 of liquid jet 43. A gap 66 may be present between the top of insulator 68 and the outlet plane of the nozzle 50. The edges of charge electrode 45 and 45*a* facing the jet 43 are shown to be angled in FIG. 8A and FIG. 8B so as to maximize the intensity of the electric field at the break off region which will induce more charge on the charged drops 36 and large charged drops 49. Insulating spacer 69 is also adhered to the bottom surface of charge electrode 45. Optional insulating spacer 71 is adhered to the bottom surface of optional charge electrode 45*a*. The bottom region of insulator 68 has an insulating adhesive 64 in the vicinity of the top surface of charge electrode 45 facing the liquid jet 43. Similarly the bottom region of optional insulator 68*a* has an insulating adhesive 64*a* in the vicinity of the top surface of charge electrode 45*a* facing the liquid jet 43. The insulating spacer 69 also has an insulating adhesive 62 adhering to the side facing the ink jet drops and the bottom surface of electrode 45. Optional insulating spacer 71 also has an insulating adhesive 62*a* adhering to the side facing the ink jet drops and the bottom surface of electrode 45. The purpose of the insulating adhesives 64, 64*a*, 62 and 62*a* is to prevent liquid from forming a continuous film on the surface of the insulators and to keep liquid away from the electrode 45 to eliminate the possibility of electrical shorting. The grounded gutter 47 is adhered to the bottom surface of insulating spacer 69 and insulating adhesive 64 as shown in FIGS. 6A and 6B. Adhering to the bottom surface of optional insulating spacer 71 is a grounded conductor 70. Another optional insulator 72 adheres to the bottom surface of grounded conductor 70. An optional deflection electrode 74 facing the top region of gutter 47 adheres to the bottom surface of insulator 72. Optional insulator 73 adheres to the bottom surface of deflection electrode 74. Grounded conductor 75 is located adjacent to the bottom region of gutter 47 and is adhered to the bottom surface of insulator 73. Grounded conductor 70 acts as a shield between electrode 45*a* and deflection electrode 74 to isolate the drop charging region near drop break off from the drop deflection fields in front of the catcher. This helps to ensure that the charge induced on the drops as they are breaking off from the jet are not impacted by the electric fields produced by the deflection electrode. The purpose of the grounded conductor 75 is to shield the drop impact region of the catcher from electric fields produced by the deflection electrode. The presence of such fields in the drop impact region can contribute to the generation of misting and spray from the gutter 47 surface. The deflection electrode 74 in FIG. 8A and FIG. 8B functions in the same manner as the deflection electrode 63 described in FIGS. 7A-7C.

Figure 9:
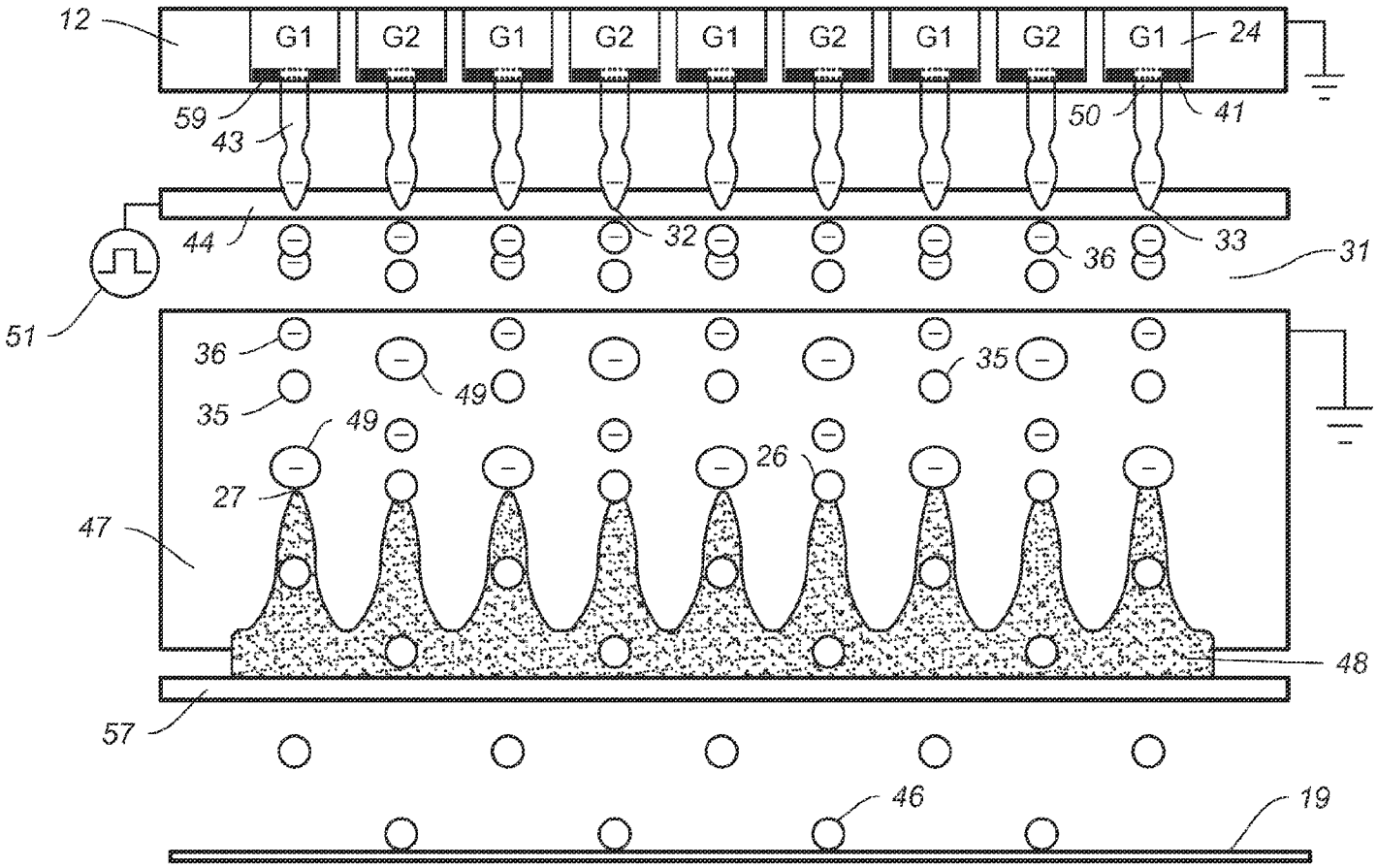
FIG. 9 shows several adjacent nozzles arranged into two groups in which every fourth drop created at the fundamental period is printed using a $2\tau_o$ timing shift between nozzles of different groups.

FIG. 9 illustrates a front view point of an array of 9 adjacent liquid jets 43 of a printhead 12 of the continuous inkjet system of the invention showing 9 adjacent nozzles arranged into two interleaved groups labeled G1 and G2 utilizing the first print drop selection scheme operating in a mode in which every fourth drop generated at the fundamental drop formation period is printed using a $2\tau_o$ timing shift between nozzles of different groups. This is representative of an all print mode at ¼ maximum print speed using a $2\tau_o$ timing shift between nozzles of different groups. In FIG. 9, a print drop 35 is preceded by a large non-print drop 49 and followed by a non-print drop 36 which is followed by the next large non-print drop 49 which precedes the next print drop. The print and non-print drops 35 and 36 are generated separated in time by the fundamental period $\tau_o$ while the large non-print drop is generated separated in time by the previous drop by about twice the fundamental period $2\tau_o$. A timing delay of $2\tau_o$ is provided between the waveforms supplied to the nozzles of groups G1 and G2. Common charge electrode 44 is associated with each of the liquid jets in the array of nozzles 12, being positioned adjacent to the break off locations 32 of drops 35 and 36 and the break off locations 33 of large drops 49. Large drops 49 break off in all of the nozzles in group G1 and non-print drops 36 break off in all of the nozzles in group G2 during the same charge electrode voltage state. Also non-print drops 36 break off in all of the nozzles in group G1 and large drops 49 break off in all of the nozzles in group G2 during the same charge electrode voltage state. All print drops 35 of nozzle groups G1 and G2 break off during a distinct charge electrode voltage state. The charge electrode waveform as shown in the example in FIG. 5B preferably would have a 50% duty cycle with a two state waveform having a period of $2\tau_o$. Grounded catcher 47 is shown to have a continuous ink film 48 formed across the entire catcher surface which is caused by charged drops 36 and charged large drops 49 being deflected and intercepted by the catcher at height locations 26 and 27 respectively while drops 35 are printed. As the path 38 of charged drops 36 and path 39 of the charged large drops 49 are substantially the same, all guttered drops intercept the catcher surface at approximately the same height. This is desirable to create a steady uniform ink film on the catcher surface and to enable high drop placement accuracy. The ink film 48 on the gutter is collected in the channel between catcher 47 and the common catcher bottom plate 57 and sent to the ink recycling unit of the printer. Print drops 35 reach the recording medium 19 as printed drops 46. Print drops from groups G1 and G2 reach the recording medium 19 at different times and are offset by each other in the recording medium motion direction by an amount dependent on print speed. When operating at ¼ the maximum print speed with a $2\tau_o$ group timing shift between nozzles of different groups this amounts to a ½ pixel offset between print drops from adjacent nozzles on the recording medium 19. When printing at 1/32 of the maximum print speed, this $2\tau_o$ group timing shift amounts to 1/16 of a pixel offset between adjacent print drops on the recording medium 19.

In some situations, it is desirable to keep a constant offset between printed drops on the recording media from nozzles of the first group G1 and nozzles of the second group G2. In this cases, the timing shift between the first nozzle group and the second nozzle group is dependent on the speed of the recording media relative to the nozzle array and results in a fixed shift between locations of printed drops created by the first nozzle group and the second nozzle group when viewed along a direction of receiver travel independent of receiver speed.

FIGS. 10-13 show sequences of lines of drops utilizing the first print drop selection scheme traveling in air from several adjacent nozzles before being deflected and intercepted by the catcher in which the print data is such that all several adjacent nozzles are being simultaneously requested to either print a print drop or a non-print drop. This corresponds to printing of horizontal lines or solid regions depending on recording medium speed. The print patterns in air shown on the left side of these figures labeled A constitute the prior art and do not utilize the methods of the present invention while the print patterns shown in air on the right side of these figures labeled B utilize the methods of this invention. The print patterns in air labeled A shown in the left side of FIGS. 10-13 do not utilize any timing shift between stimulation of adjacent nozzles and the nozzles are not separated into two or more groups while the print patterns in air labeled B shown in the right side of FIGS. 10-13 are generated from adjacent nozzles in two or more groups with timing shifts between triggering simulation of nozzles of different groups. In all these figures print drops 35 are indicated as patterned filled circles, non-print drops 36 are indicated as solid black filled circles and large non-print drops 49 are indicated as larger solid black filled circles. In all these figures, a single line of all print drops on all seven nozzles are labeled 1-7.

Figure 10B:
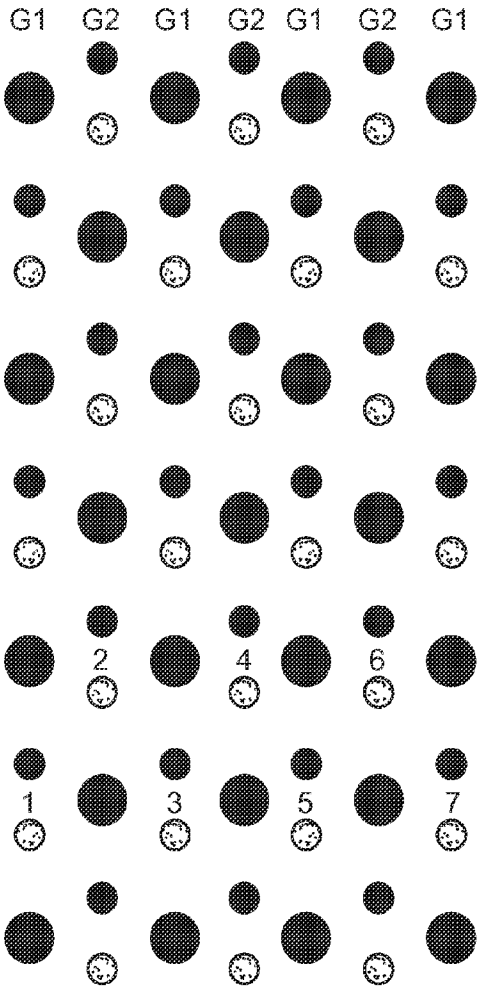
FIG. 10B (Prior Art)
FIG. 10B shows a sequence of drops traveling in air from several adjacent nozzles before being deflected in which every fourth drop created at the fundamental period is to be printed using a $2\tau_o$ timing shift between nozzles arranged in two nozzle groups according to an embodiment of this invention.
Figure 10A:
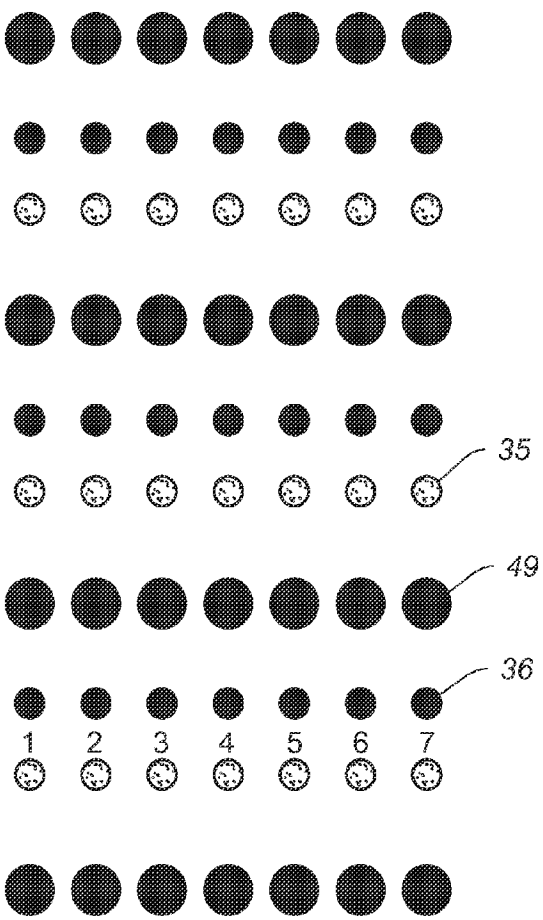
FIG. 10A (Prior Art)
FIG. 10A shows a sequence of drops traveling in air from several adjacent nozzles before being deflected in which every fourth drop created at the fundamental period is to be printed using no timing shift between nozzles in two different groups.

FIG. 10A shows a sequence of drops traveling in air from several adjacent nozzles before being deflected in which every fourth line of drops created at the fundamental period is to be printed using no timing shift between nozzles in different groups while FIG. 10B shows the same sequence of drops traveling in air from the same several adjacent nozzles before being deflected in which every fourth drop created at the fundamental period is to be printed applying the method and an embodiment of this invention using a $2\tau_o$ timing shift between adjacent nozzles which are arranged into two groups labeled G1 and G2. The drop pattern shown in FIG. 10B corresponds to that is described in FIG. 9 before the non-print drops are intercepted by the catcher. In the examples shown in FIGS. 10A and 10B a print drop 35 is preceded by a large non-print drop 49 followed by a non-print drop 36 which is followed by the next large non-print drop 49 which precedes the next print drop. The print and non-print drops 35 and 36 are generated separated in time by the fundamental period $\tau_o$ while the large non-print drop is generated separated in time by the previous drop by about twice the fundamental period $2\tau_o$. In the print mode shown in FIG. 10A print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 10B print drops in air labeled 1 and 2, 2 and 3, 3 and 4, 4 and 5, 5 and 6 and 6 and 7 are much farther apart from each other than in the case of FIG. 10A. This decreases drop to drop electrostatic interactions on adjacent charged print drops resulting in less electrostatic repulsion between adjacent print drops. The electrostatic interactions between adjacent charged print drops cause the print drops to displace away from each other when no group timing delay between adjacent nozzles is used. Whereas when using the group timing delay of $2\tau_o$ between adjacent nozzles as shown in FIG. 10B, there is significantly reduced displacement of adjacent charged print drops. In the example shown in FIG. 10B, the presence of large non-print drops 49 between successive print drops 35 also helps in reducing electrostatic interactions between adjacent print drops.

Figure 11B:
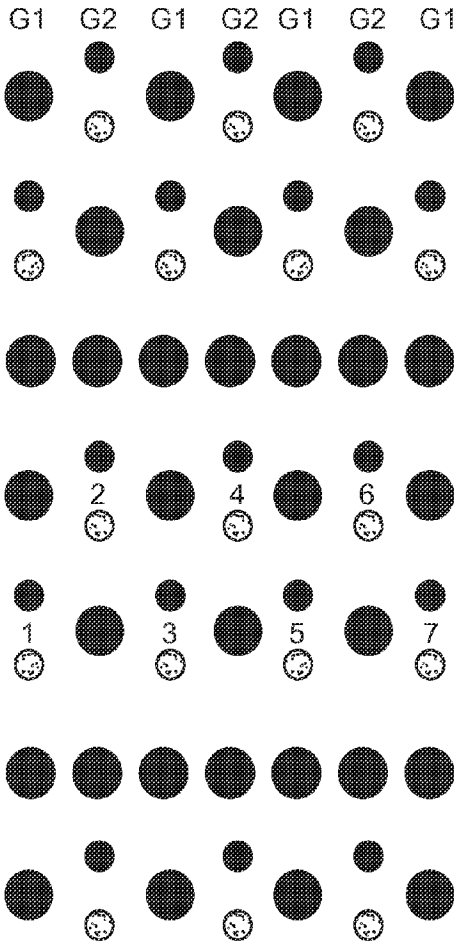
FIG. 11B (Prior Art)
FIG. 11B shows a sequence of drops traveling in air from several adjacent nozzles before being deflected in which every sixth drop created at the fundamental period is to be printed using a $2\tau_o$ timing shift between nozzles arranged into two nozzle groups according to an embodiment of this invention.
Figure 11A:
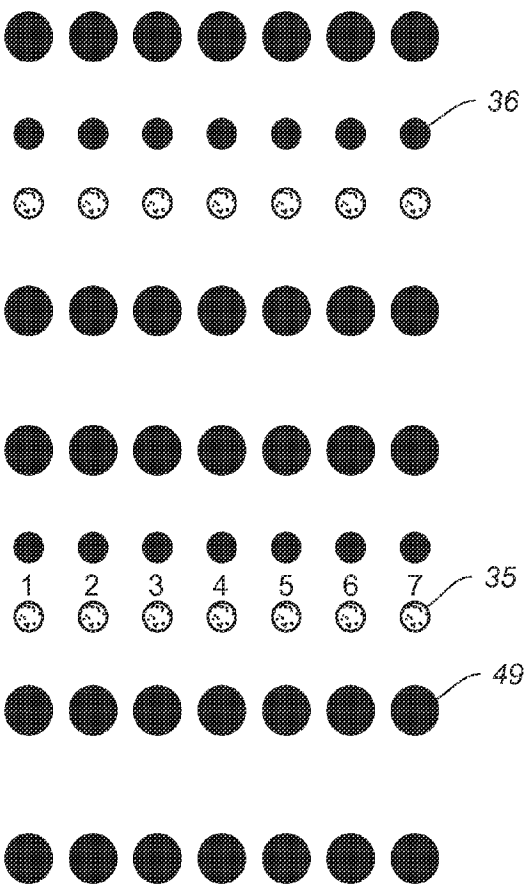
FIG. 11A (Prior Art)
FIG. 11A shows a sequence of drops traveling in air from several adjacent nozzles before being deflected in which every sixth drop created at the fundamental period is to be printed using no timing shift between nozzles in different groups.

FIG. 11A shows a sequence of drops utilizing the first print drop selection scheme traveling in air from several adjacent nozzles before being deflected in which every sixth line of drops created at the fundamental period is to be printed using no timing shift between nozzles in different groups while FIG. 11B shows the same sequence of drops traveling in air from the same several adjacent nozzles before being deflected in which every sixth drop created at the fundamental period is to be printed applying the method and an embodiment of this invention using a $2\tau_o$ timing shift between adjacent nozzles which are arranged into two groups labeled G1 and G2. In FIGS. 11A and 11B a print drop 35 is preceded by two consecutive large non-print drops 49 followed by a non-print drop 36 which is followed by the next pair of consecutive large non-print drops 49 which precedes the next print drop. As in the cases shown in FIGS. 10A and 10B the print and non-print drops 35 and 36 are generated separated in time by the fundamental period $\tau_o$ while the large non-print drop is generated separated in time by the previous drop by about twice the fundamental period $2\tau_o$. In the print mode shown in FIG. 11A print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 11B print drops in air labeled 1 and 2, 2 and 3, 3 and 4, 4 and 5, 5 and 6 and 6 and 7 are again much farther apart from each other than in the case of FIG. 11A. This decreases drop to drop electrostatic interactions on adjacent charged print drops resulting in less electrostatic repulsion between adjacent print drops.

Figure 12B:
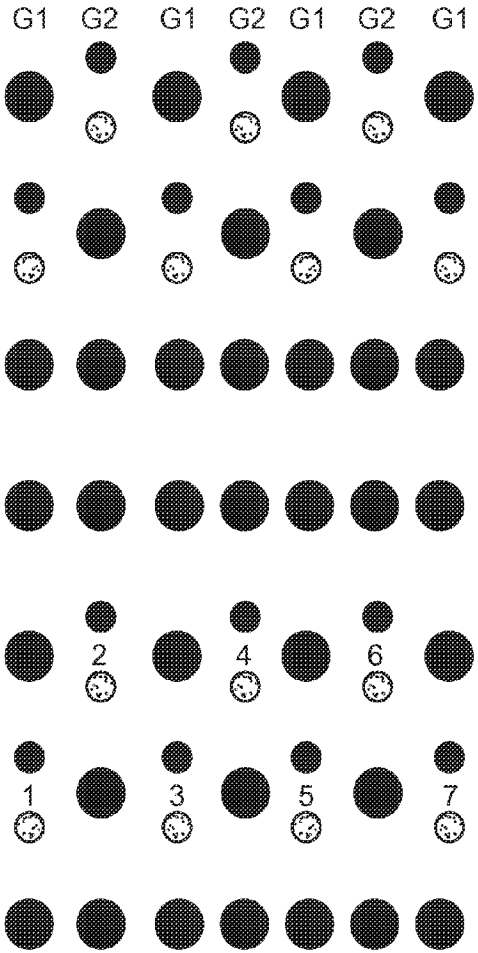
FIG. 12B (Prior Art)
FIG. 12B shows a sequence of drops traveling in air from several adjacent nozzles before being deflected in which every eighth drop created at the fundamental period is to be printed using a $2\tau_o$ timing shift between nozzles arranged into two nozzle groups according to an embodiment of this invention.
Figure 12A:
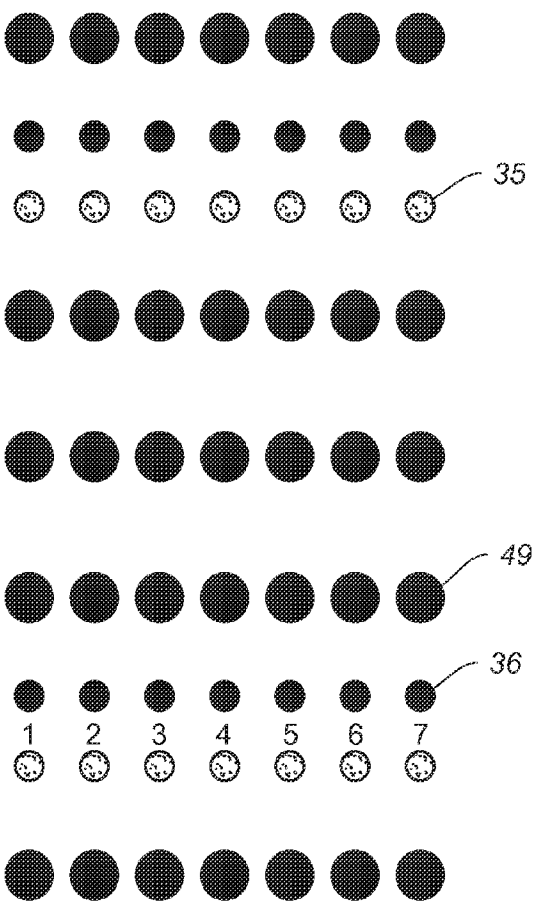
FIG. 12A (Prior Art)
FIG. 12A shows a sequence of drops traveling in air from several adjacent nozzles before being deflected in which every eighth drop created at the fundamental period is to be printed using no timing shift between nozzles in different groups.

FIG. 12A shows a sequence of drops traveling in air from several adjacent nozzles before being deflected in which every eighth line of drops created at the fundamental period is to be printed using no timing shift between nozzles in different groups while FIG. 12B shows the same sequence of drops traveling in air from the same several adjacent nozzles before being deflected in which every eighth drop created at the fundamental period is to be printed applying the method and an embodiment of this invention using a $2\tau_o$ timing shift between adjacent nozzles which are arranged into two groups labeled G1 and G2. In FIGS. 12A and 12B, a print drop 35 is preceded by three consecutive large non-print drops 49 followed by a non-print drop 36 which is followed by the next set of three consecutive large non-print drops 49 which precedes the next print drop. As in the cases shown in FIGS. 10A, 10B, 11A and 11B, the print and non-print drops 35 and 36 are generated separated in time by the fundamental period $\tau_o$ while the large non-print drop is generated separated in time by the previous drop by about twice the fundamental period $2\tau_o$. In the print mode shown in FIG. 12A, print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 12B print drops in air labeled 1 and 2, 2 and 3, 3 and 4, 4 and 5, 5 and 6 and 6 and 7 are again much farther apart from each other than in the case of FIG. 12A. This again decreases charge to charge interactions on adjacent charged print drops resulting in less electrostatic repulsion between adjacent print drops.

Figure 13B:
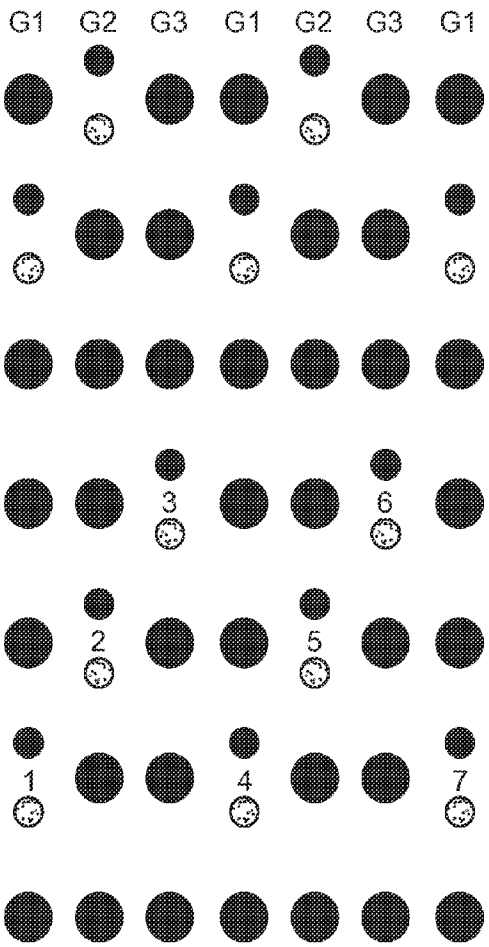
FIG. 13B (Prior Art)
FIG. 13B shows a sequence of drops travelling in air from several adjacent nozzles in an all print mode before deflection for printing on a substrate traveling at one eighth maximum print speed using a $2\tau_o$ or $4\tau_o$ timing shift between adjacent nozzles arranged into three nozzle groups according to an embodiment of this invention.
Figure 13A:
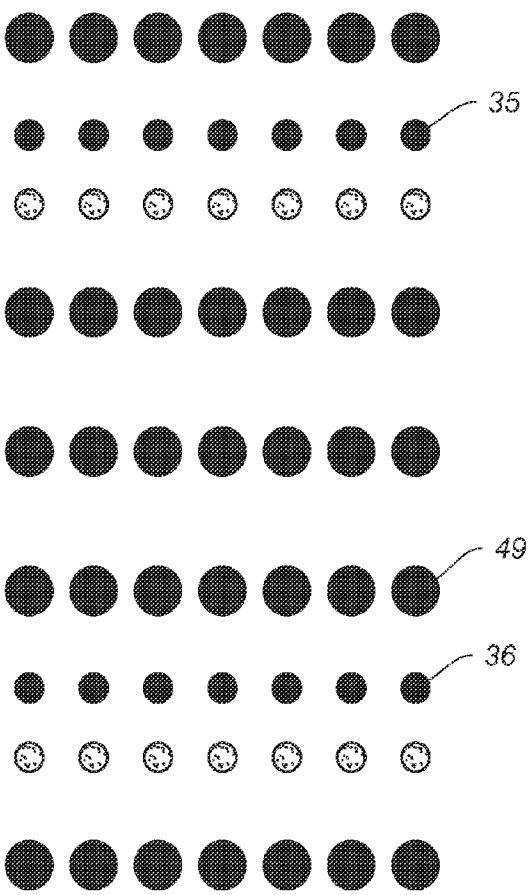
FIG. 13A (Prior Art)
FIG. 13A shows a sequence of drops travelling in air from several adjacent nozzles in an all print mode before deflection for printing on a substrate traveling at one eighth maximum print speed using no timing shift between nozzles in different groups.

FIG. 13A shows a sequence of drops traveling in air from several adjacent nozzles before being deflected in which every eighth line of drops created at the fundamental period is to be printed using no timing shift between nozzles in different groups while FIG. 13B shows the same sequence of drops traveling in air from the same several adjacent nozzles before being deflected in which every eighth drop created at the fundamental period is to be printed applying the method and an alternate embodiment of this invention using $2\tau_o$ and $4\tau_o$ timing shifts between pairs of adjacent nozzles are arranged into three groups labeled G1, G2 and G3. In FIGS. 13A and 13B a print drop 35 is preceded by three consecutive large non-print drops 49 followed by a non-print drop 36 which is followed by the next set of three consecutive large non-print drops 49 which precede the next print drop. In the examples shown in FIGS. 10A, 10B, 11A, 11B, 12A and 12B the print and non-print drops 35 and 36 are generated separated in time by the fundamental period $\tau_o$ while the large non-print drop is generated separated in time by the previous drop by about twice the fundamental period $2\tau_o$. In the print mode shown in FIG. 13A print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 13B print drops in air labeled 1 and 2, 2 and 3, 4 and 5, 5 and 6 have a $2\tau_o$ timing shift between them and are again much farther apart from each other than in the case of FIG. 11A and print drops in air labeled 3 and 4 and 6 and 7 have a $4\tau_o$ timing shift between them causing them to be farther apart from each other than print drops in air labeled 1 and 2, 2 and 3, 4 and 5, 5 and 6. This further decreases charge to charge interactions on adjacent charged print drops resulting in less electrostatic repulsion between adjacent print drops.

The first print drop selection scheme described above cannot be utilized when printing at maximum print speed or recording medium speed based on the fundamental frequency of drop generation since there is always at least one non-print drop between successive print drops from a single nozzle. In systems where printing at maximum recording media speed is required, the second print drop selection scheme can be utilized. In embodiments utilizing the second print drop selection scheme, the periodic stimulation of the liquid jets 43 cause the jets to break off into sequences of print drops 35 or non-print drops 36 without the use of larger drops 49. One drop, either a print drop 35 or a non-print drop 36 breaks off during each fundamental time interval $\tau_o$ so that successive drops are separated in time on average by the drop period $\tau_o$, and the set of predefined stimulation waveforms 55 applied to the stimulation transducers 59 includes one or more waveforms for the formation of print drops 35 and one or more waveforms for the creation of non-print drops 36. Successive drops are separated on average by the distance $\lambda$. When utilizing the second print drop selection scheme, the charging device 83 needs to be synchronized with the drop formation waveform source 56 and the group timing delay device 78 to produce a print drop charge state on the print drops and to produce a non-print drop charge state on the non-print drops which is substantially different from the print drop charge state. In order to enable proper synchronization, the source of varying electrical potential 51 applies a charge electrode waveform 97 to the common charge electrode 44 having a period that is equal to the drop formation fundamental period $\tau_o$. The charge electrode waveform has two distinct voltage states called the print drop voltage state and the non-print drop voltage state. When the input image data calls for a print drop, the print drop formation waveform causes the break off of the drop from the liquid jet to occur while the charge electrode waveform is in the print drop voltage state. Conversely, when the input image data calls for a non-print drop, the non-print drop formation waveform causes the break off of the drop from the liquid jet to occur while the charge electrode waveform is in the non-print drop voltage state.

Figure 14A:
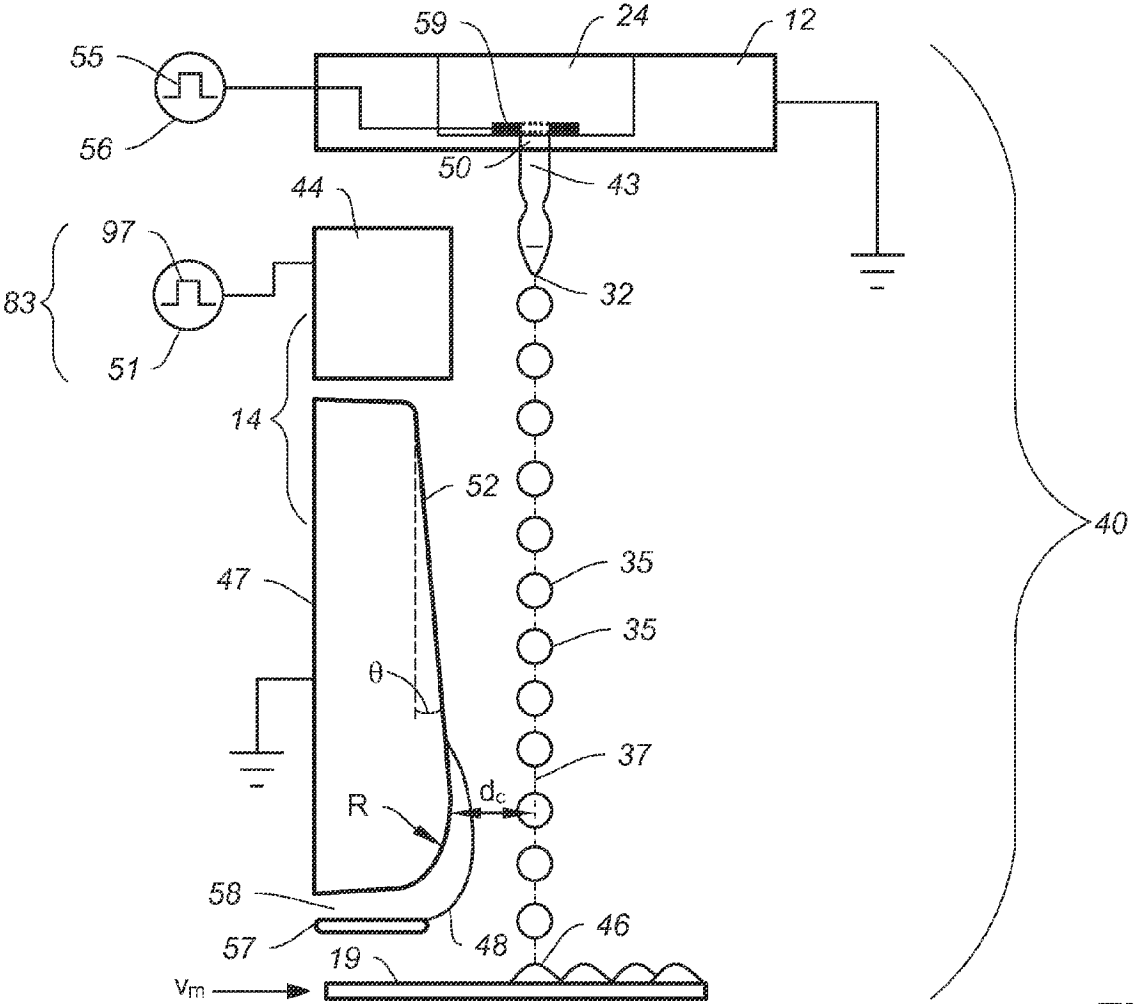
FIG. 14A shows a cross sectional viewpoint through a liquid jet of an alternate embodiment of the continuous liquid ejection system according to this invention operating at maximum recording medium speed in an all print condition.
Figure 14B:
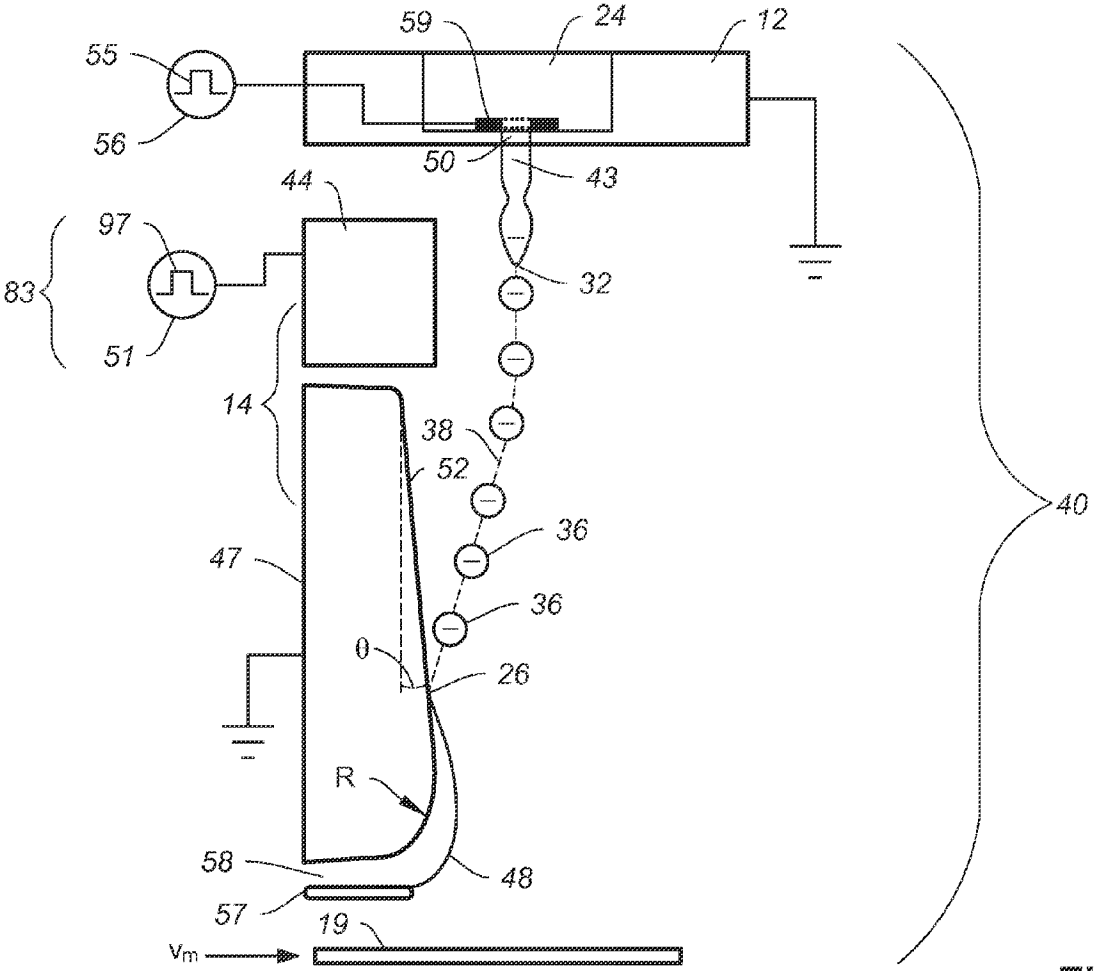
FIG. 14B shows a cross sectional viewpoint through a liquid jet of an alternate embodiment of the continuous liquid ejection system according to this invention operating at maximum recording medium speed in a no print condition.
Figure 14C:
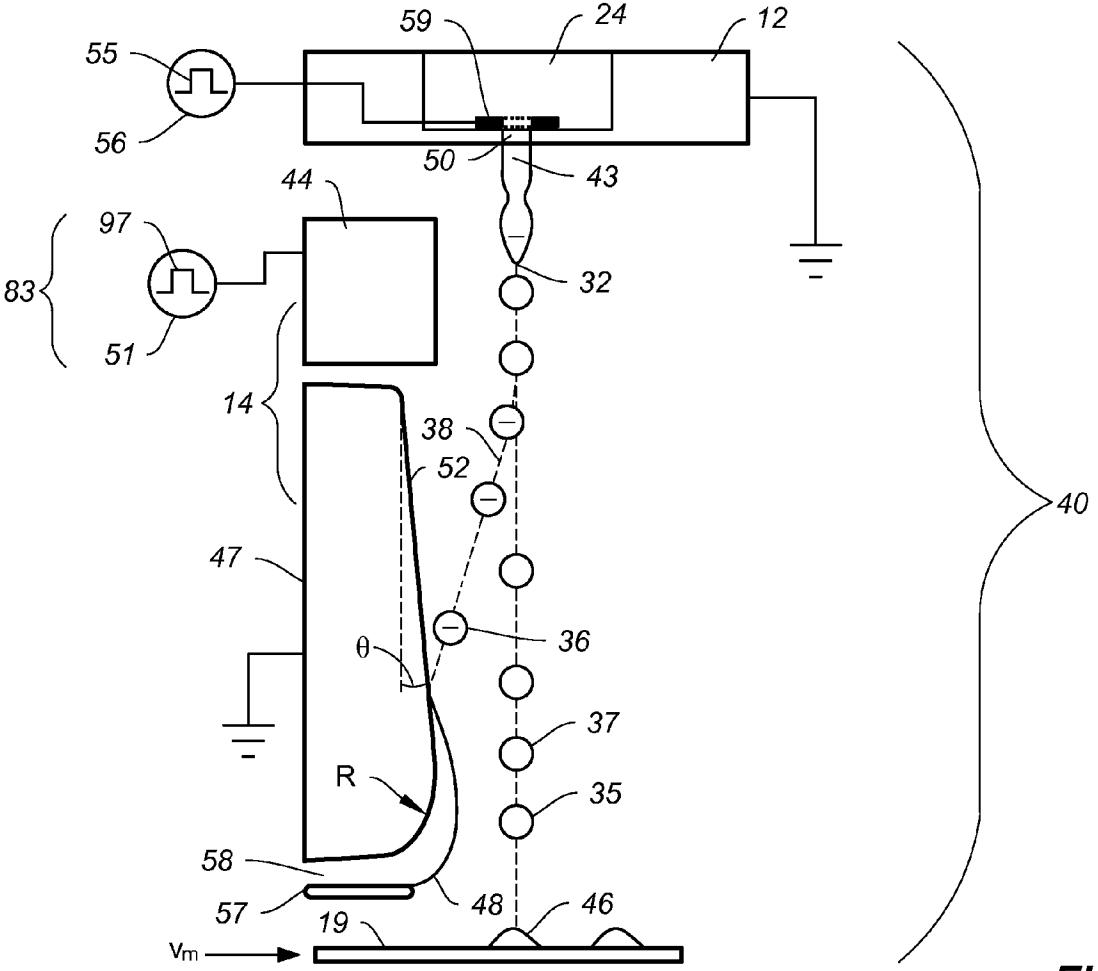
FIG. 14C shows a cross sectional viewpoint through a liquid jet of an alternate embodiment of the continuous liquid ejection system according to this invention operating at maximum recording medium speed illustrating a general print condition.

FIGS. 14A-14C show an alternate embodiment of a continuous liquid ejection system 40 used in the practice of this invention utilizing the second print drop selection scheme. All of the components of the apparatus shown in FIGS. 14A-14C are the same as the components described in FIGS. 6A-6C. When using the second print drop selection scheme, the stimulation waveform source 56 and the charging voltage source are adapted to apply different sets of stimulation waveforms 55 and charge electrode waveforms respectively than when using the first print drop selection scheme. FIG. 14A shows an all print condition utilizing the second print drop selection scheme in which every successive drop 35 generated at the fundamental frequency is printed demonstrating printing at maximum recording medium speed. FIG. 14B shows a no print mode utilizing the second print drop selection scheme in which continuous sequences of drops 36 are produced at the fundamental frequency and none of the drops are printed. FIG. 14C shows a general print mode utilizing the second print drop selection scheme operating at maximum recording medium speed in which some drops generated at the fundamental frequency are printed and some are not printed and collected by catcher 47 and recycled.

Figure 15B:
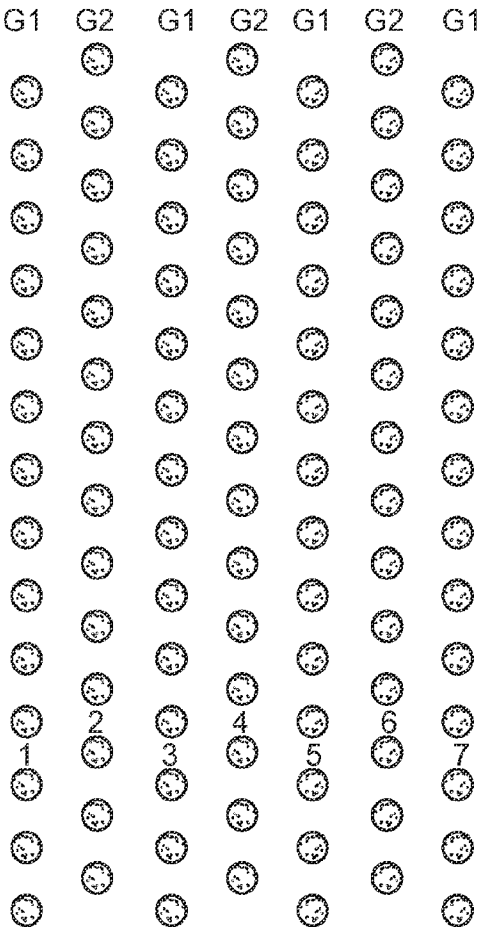
FIG. 15B (Prior Art)
FIG. 15B shows a sequence of drops travelling in air from several adjacent nozzles in an all print mode before deflection for printing on a substrate traveling at maximum print speed using an $0.3\tau_o$ timing shift between nozzles arranged into two nozzle groups according to an alternate embodiment of this invention.
Figure 15A:
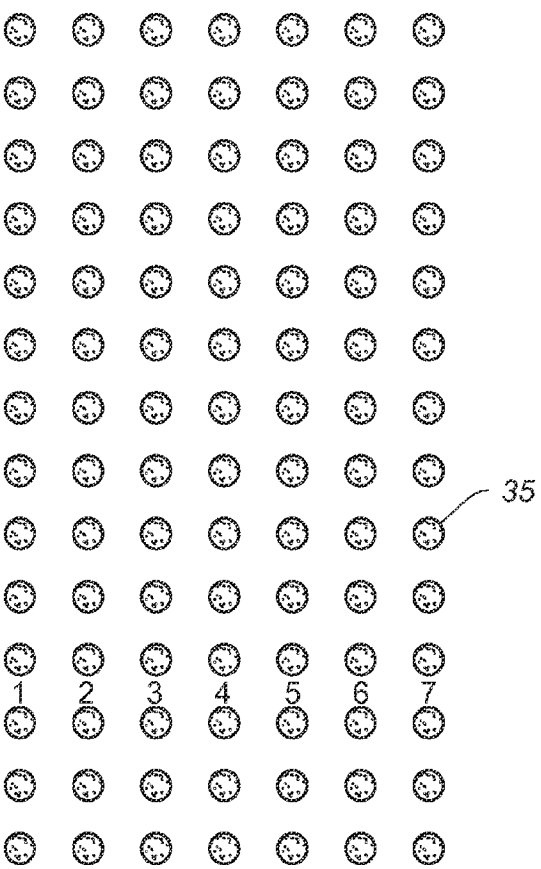
FIG. 15A (Prior Art)
FIG. 15A shows a sequence of drops travelling in air from several adjacent nozzles in an all print mode before deflection for printing on a substrate traveling at maximum print speed using no timing shift between nozzles in different groups.

FIG. 15 and FIG. 17 show sequences of lines of drops utilizing the second print drop selection scheme traveling in air from several adjacent nozzles, before non-print drops are deflected and intercepted by the catcher, in which the print data is such that all of the several adjacent nozzles are being simultaneously requested to either print a print drop or a non-print drop. This corresponds to printing of horizontal lines or solid regions depending on recording medium speed. The print patterns in air shown on the left side of these figures, labeled A, constitute the prior art and do not utilize the methods of the present invention while the print patterns shown in air on the right side of these figures, labeled B, utilize the methods of this invention. FIG. 15A shows a sequence of drops traveling in air from several adjacent nozzles in which every line of drops created at the fundamental period is to be printed using no timing shift between nozzles in different groups while FIG. 15B shows the same sequence of drops traveling in air from the same several adjacent nozzles in which every drop created at the fundamental period is to be printed applying the method and the above alternate embodiment of this invention using a $0.3\tau_o$ timing shift between adjacent nozzles which are arranged into two groups. FIGS. 15A and 15B are examples of all print conditions operating at the maximum print speed and can be generated showing utilizing the apparatus shown in FIG. 14A. In this case, all drops being generated are print drops 35. In the print mode shown in FIG. 15A print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention shown in FIG. 15B print drops in air labeled 1 and 2, 2 and 3, 3 and 4, 4 and 5, 5 and 6 and 6 and 7 are again farther apart from each other than in the case of FIG. 15A. The vertical distance between adjacent drops from adjacent nozzles corresponds to a time delay of drop break off of $0.3\tau_o$. This, again decreases charge to charge interactions between adjacent charged print drops resulting in less electrostatic repulsion between adjacent print drops.

Figure 16:
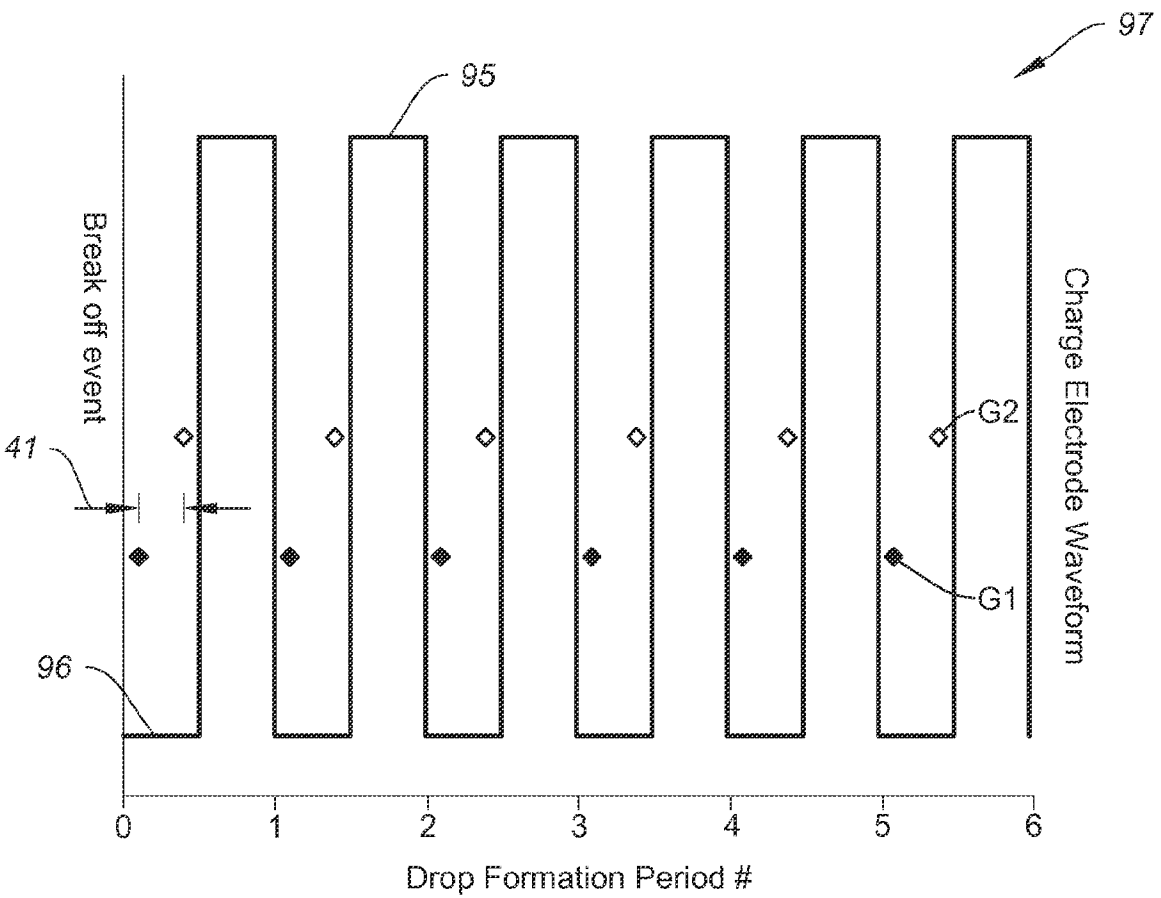
FIG. 16 shows a timing diagram illustrating the charge electrode waveform and the break off timing of drops for nozzles in group 1 and group 2 when printing all drops at maximum recording medium speed using a group time delay of $0.3\tau_o$.

FIG. 16 shows a timing diagram illustrating the charge electrode waveform and the break off timing of drops from representative nozzles in nozzle group G1 and nozzle group G2 when printing all drops at maximum recording medium speed utilizing the second print drop selection scheme as shown in FIG. 15B and FIG. 14A. The break off timing of the drops of the nozzle groups G1 and G2 is shown along with the charge electrode voltage waveform as a function of time in units of drop formation fundamental periods $\tau_o$. During each drop formation fundamental period one drop is generated from each nozzle. The labeled items in FIG. 16 have the same meanings as the similarly numbered labels in section B of FIG. 5. In FIG. 16 the group timing delay 41 is $0.3\tau_o$ which corresponds to the vertical separation between drops in air labeled 1 and 2, 2 and 3, 3 and 4, 4 and 5, 5 and 6 and 6 and 7 shown in FIG. 15B.

Figure 17B:
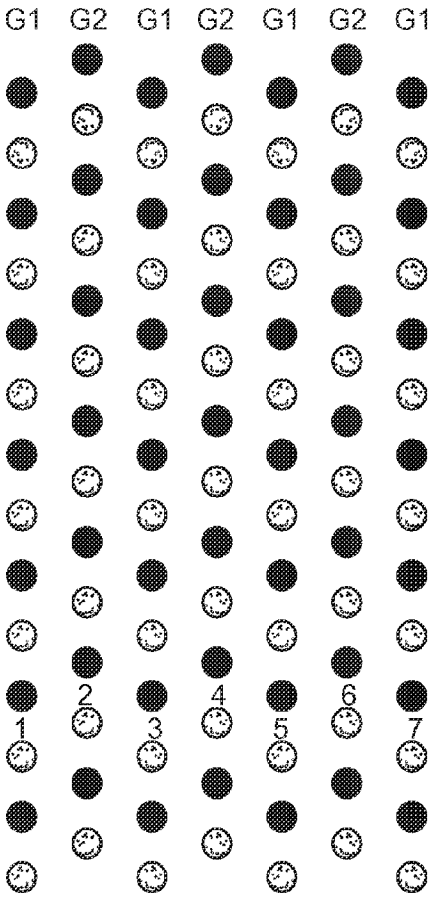
FIG. 17B (Prior Art)
FIG. 17B shows a sequence of drops traveling in air from several adjacent nozzles before being deflected in which every other drop created at the fundamental period is to be printed using a $0.3\tau_o$ timing shift between nozzles arranged into two nozzle groups according to an embodiment of this invention.
Figure 17A:
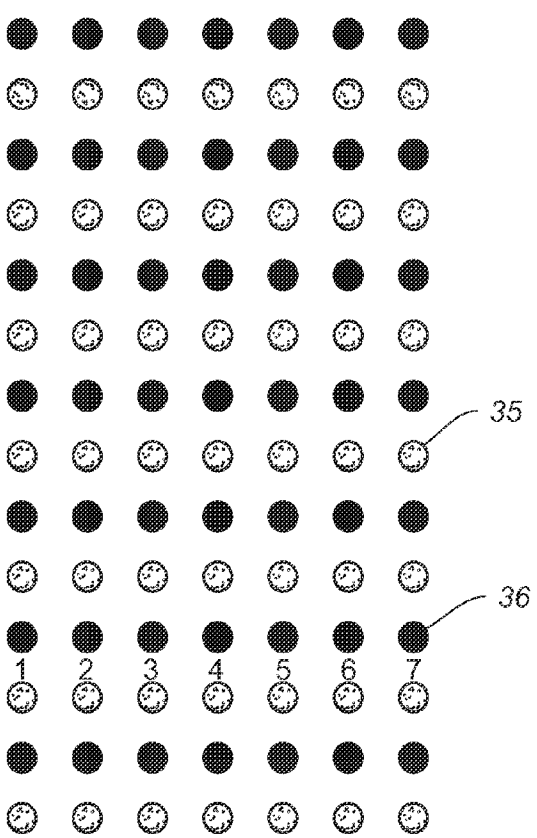
FIG. 17A (Prior Art)
FIG. 17A shows a sequence of drops traveling in air from several adjacent nozzles before being deflected in which every other drop created at the fundamental period is to be printed with no timing shift between nozzles in different groups.

FIG. 17A shows a sequence of drops traveling in air from several adjacent nozzles in which every other drop from each nozzle, created at the fundamental period, is to be printed using no timing shift between nozzles in different groups, while FIG. 17B shows the same sequence of drops traveling in air from the same several adjacent nozzles in which every other drop, created at the fundamental period, is to be printed applying the method and an embodiment of this invention using a $0.3\tau_o$ timing shift between adjacent nozzles which are arranged into two groups. Here a print drop 35 is preceded by a non-print drop 36, and is followed by a non-print drop 36 which precedes the next print drop 35. In the print mode shown in FIG. 17A print drops in air labeled 1 and 2, 2 and 3, 3 and 4, 4 and 5, 5 and 6 and 6 and 7 are adjacent to each other with the distance between them being equal to the nozzle spacing. In the print mode practiced in this invention, shown in FIG. 17B, print drops in air labeled 1 and 2, 2 and 3, 3 and 4, 4 and 5, 5 and 6 and 6 and 7 are farther apart from each other than in the case of FIG. 17A due to the phase shift between the stimulation waveforms applied to the drop formation devices associated with nozzles of the first group and the stimulation waveforms applied to the drop formation devices associated with the nozzles of the second group. This again decreases charge to charge interactions between adjacent charged print drops resulting in less electrostatic repulsion between adjacent print drops. Thus, increasing the distance between print drops of neighboring jets, by using a timing shift between drop formation waveforms supplied to two groups of nozzles reduces the magnitude of electrostatic interactions between charged print drops and reduces the drop placement errors that occur as these drops are printed on a recording medium.

Figure 18:
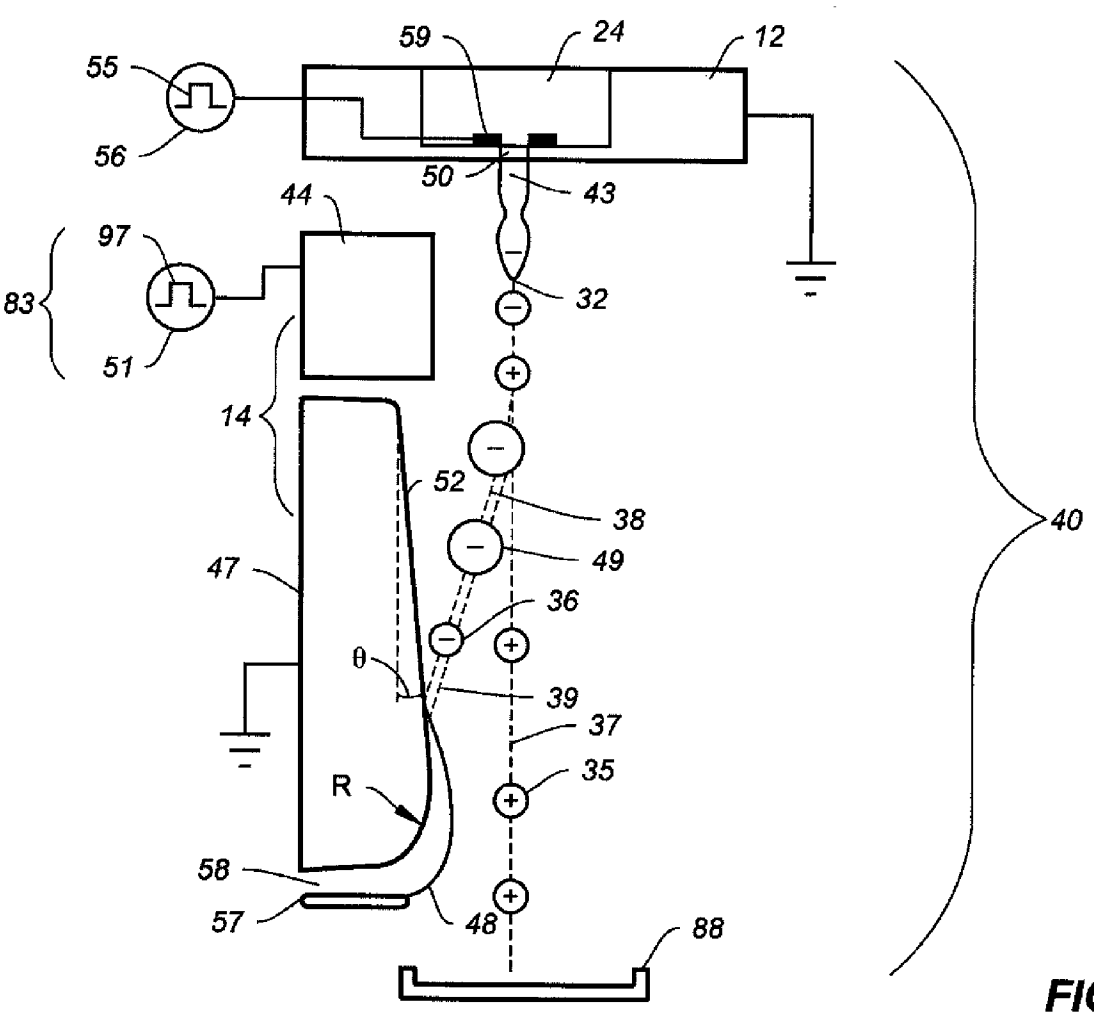
FIG. 18 shows a cross sectional viewpoint through a liquid jet of the first embodiment of the continuous liquid ejection system according to this invention with a print charge measurement device.

Another aspect of this invention includes controlling the print drop charge. The source of print drop charge is the local electrostatic field in liquid jet break off area when print drops break off from the liquid jets. This local electrostatic field depends on the print drop voltage state of the charge electrode and on the charge state and the spacing of previously formed drops. The electrostatic field from previously formed drops can cause significant induced charge on the print drop even when charge electrode is at the ground voltage state at the time of print drop break off. The induced charge on the print drops, produced by the preceding charged non-print drops, is of opposite polarity of that of non-print drops. For example, if the non-print drops are negatively charged, print drops are positively charged. This has been verified using the apparatus shown in FIG. 18 which shows a cross sectional viewpoint through a liquid jet of an embodiment of a continuous inkjet system utilizing the first print drop selection scheme. The print condition shown in FIG. 18 is similar to the general print condition shown in FIG. 6C where recording medium 19 is replaced with a print charge measurement device 88. Here, a positive charge is induced on print drops 35 breaking off from liquid jet 43 while non-print drops 36 and large drops 49 are negatively charged.

As a common charge electrode is used, the print drop voltage state of the charge electrode is controlled by charge electrode waveform 97 and is always the same for all print drops. However, the spatial distribution of charged drops in the vicinity of jet break off at the time of print drop formation is image data dependent. Thus, the electrostatic field at the jet break off region, and therefore the print drop charge state is image data dependent. This causes the print drops to have charge states which are not independent of input image data and the drop placement errors caused by electrostatic interactions are dependent on the input image pattern. The timing shift between the groups of nozzles disclosed in this invention significantly reduces the magnitude of electrostatic interactions and magnitude of drop placement error by increasing the spacing between print drops. However in certain applications which require the best drop placement accuracy possible, there could still be a need to address the issue of image dependent print drop charge and related drop placement errors. In conventional CIJ printers, input image data dependent charge electrode voltage waveforms are used. Therefore, it is possible to develop waveforms for consistent print drop charge independent of image data. This is not possible with the current invention as it utilizes a common charge electrode 44 supplied by input image data independent waveform 97. Therefore, a solution is needed to create consistent electrostatic field induced by neighboring drops at the time of print drop break off that is independent of image data.

Figure 19:
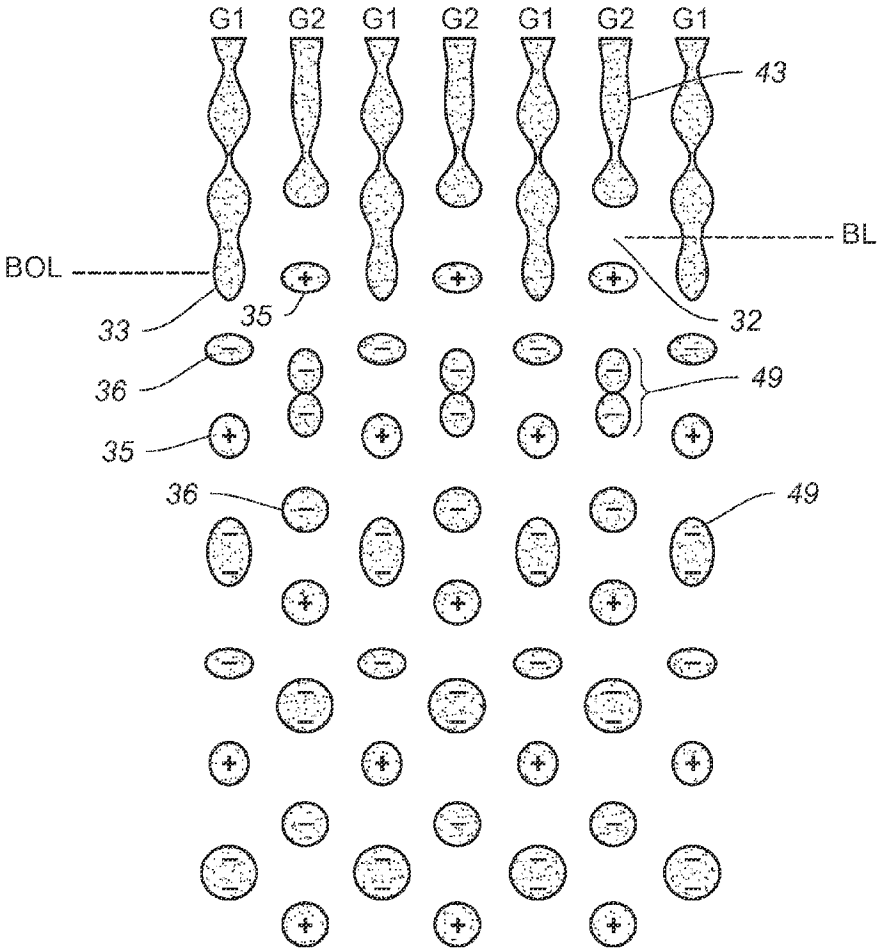
FIG. 19 shows a jet break off region for several adjacent liquid jets according to the first embodiment of the continuous liquid ejection system according to this invention with a $2\tau_o$ timing shift between nozzles arranged into two nozzle groups and a guard large drop between successive drop pairs of the same liquid jet.

An embodiment of the present invention that utilizes the first print drop selection scheme provides a solution to this problem by forming at least one large non-print drop between any two successive print drops of the same liquid jet and using a $2\tau_o$ timing shift between two groups of nozzles. This is shown in FIG. 19, which is similar to the print and non-print drop pattern discussed in FIG. 9 and shows a closer view of jet break off region. Here, the first group of nozzle G1 is made of odd numbered nozzles and the second group of nozzle G2 made of even numbered nozzles. Every print drop 35 is preceded by a negatively charged large non-print drop 49, called as a guard drop and followed by a negatively charged non-print drop 36. The presence of preceding large non-print drop 49 help in creating consistent electrostatic field in jet break off region independent of image data. Further, in the configuration shown in FIG. 19, when any print drop 35 breaks off from a liquid jet, the two adjacent jets from opposite nozzle group are always in the same condition, i.e. the two jets are in a process of forming a large non-print drop 49 which break off after break off of print drop 35. This consistent arrangement of charged drops and liquid jets in the vicinity of jet break off at the time of print drop formation enables an induced charge on the print drops 35 that is substantially independent of input image data.

In addition to these improvements in reducing the electrostatic interactions, it is further desirable to reduce charge on print drops to as close to zero as possible. As shown in FIG. 18, a print drop charge measurement device 88 that is used to intercept the print drops 35 for measurement of their charge state. The measurement gives an average charge on print drops by measuring a current produced by charged print drops when connected to ground using an electric current measurement instrument (not shown). Typically a non-zero print drop voltage state of waveform 97 supplied to the charge electrode 44 is used to reduce induced print drop charge. The non-zero print drop voltage state 96, also called an offset voltage, is selected so that the electrostatic field from the charge electrode and that from preceding drops cancel each other to have a zero net electrostatic field in the jet break region at the time of print drop break off. The result is a print drops with essentially no charge. Such print drops do not undergo any significant deflection due to electrostatic forces. Print drop charge measurement device 88 can be used to tune the low and high voltage states of charge electrode waveform 97 to produce close to zero average charge on print drops. The magnitude of offset voltage on the specific configuration of the system including, for example, whether one charging electrode or two charging electrodes are used in the system, or the geometry of the system, including, for example, the relative positioning of the jet and the charging electrode(s). Typically, the range of the print drop voltage state to the non-print drop voltage state is between 60% and 10%. For example, in some applications when the non-print drop voltage state includes 200 volts, the print drop state includes 100 volts (50% of the first voltage state).

In certain embodiments of this invention, the print drop charge measurement device 88 is located directly below the printing location on the recording medium and print drop charge measurements are performed when the recording medium is not present. In other embodiments, the print drop charge measurement device 88 is located in a separate station and the print head is physically moved to the charge measurement station for measurement to occur. This separate station can also be used for print head cleaning. In the embodiments employing the print drop charge measurement device 88, the voltage level of the print drop voltage state applied to charging voltage source 51 can be automatically adjusted utilizing a feedback loop until the magnitude of the average measured print drop charge is a minimum. FIG. 18 shows the print drop charge measurement device 88, such as a Faraday cup that intercepts the print drops. The print drop charge measurement device of the invention is not limited to devices that contact the print drops to determine the print drop charge. Other drop charge measurement devices such as devices that determine drop charge by capacitive coupling, which are known may also be effectively used to determine the charge on the print drops so that the charge on the print drop can be tune to approximately zero charge.

Figure 20:
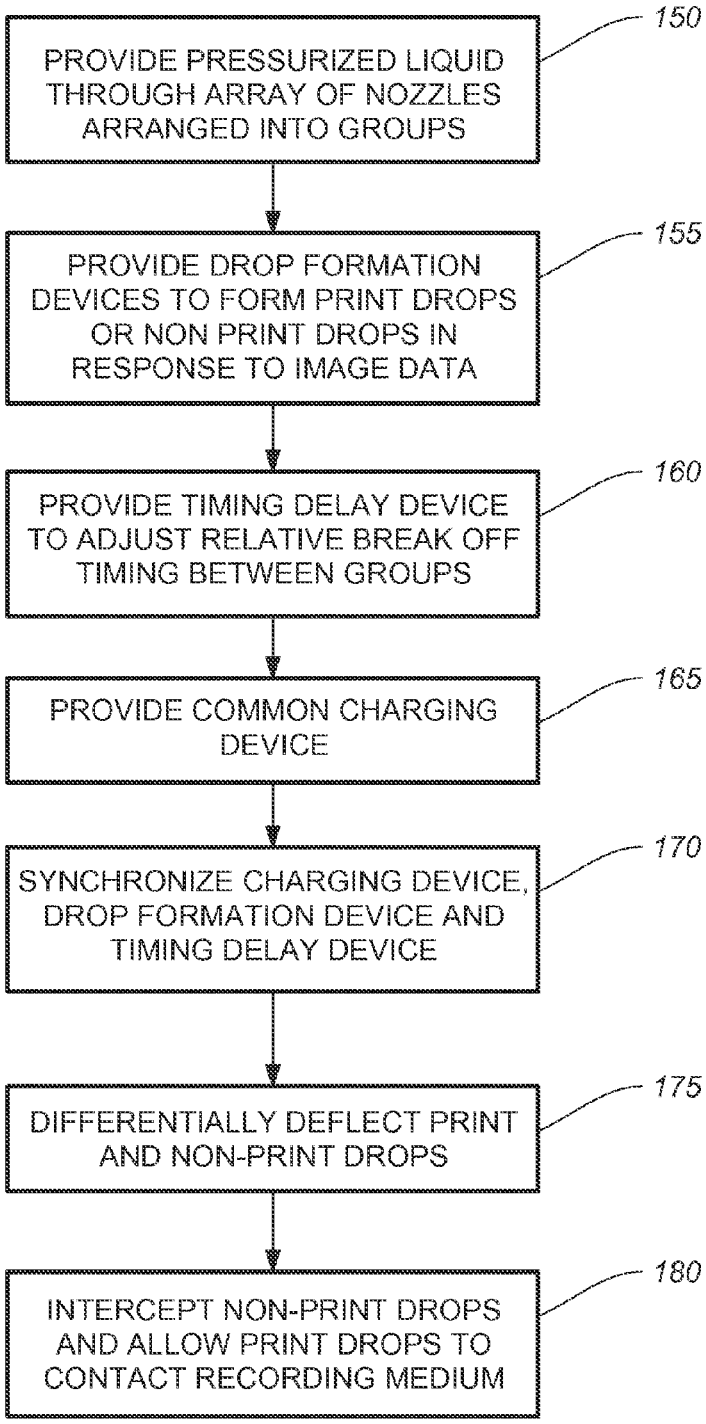
FIG. 20 shows a block diagram of the method of printing according to various embodiments of the invention.

FIG. 20 shows a block diagram outlining the steps required to practice the method of printing according to various embodiments of the invention. Referring to FIG. 20, the method of printing begins with step 150. In step 150, pressurized liquid is provided under a pressure that is sufficient to eject a liquid jet through a linear array of nozzles in a liquid chamber in which the nozzles are arranged into two or more groups of nozzles in which adjacent nozzles are in different groups. Step 150 is followed by step 155.

In step 155, the liquid jets are modulated by providing drop formation devices associated with each of the liquid jets with drop formation waveforms that cause portions of the liquid jets to break off into a series of print drops or non-print drops in response to image data. The image data and the known recording medium speed during printing are used to determine which drop formation waveform is applied to each of the drop formation devices in an array of nozzles as a function of time. The drop formation waveforms controls one or more of the break off timing or phase relative to the charging waveform applied to the charge electrode, the drop velocity, and the size of the drop being formed to determine whether a print drop or a non-print drop is formed. Step 155 is followed by step 160.

In step 160, a timing delay device is provided to adjust the relative break off timing between nozzles of different groups. This is a crucial step in the practice of this invention. It is to be noted that the timing delay device can be separate triggers with a time delay applied to the different groups as described in the discussion of FIG. 3 or it can be inherent in the waveforms applied to the nozzle array or it can be a provided by shifting of the input image data. Step 160 is followed by step 165.

In step 165, a common charging device is provided which is associated with the liquid jets. The common charging device includes a charge electrode and a charging voltage source. A charge electrode waveform which includes a first distinct voltage state and a second distinct voltage state is applied to the charging voltage source which results in a varying electrical potential in the vicinity of drop break off from the jets. The first and second voltage states are also called print drop voltage states and non-print drop voltage states respectively. The charge electrode waveform has a period equal to the minimum time interval between successive print drops defined as the print period. The charge electrode waveform is independent of the image data applied to the drop formation devices of the nozzles. Step 165 is followed by step 170.

In step 170, the charging device, the drop formation device and the timing delay device are synchronized so that the print drop voltage state is active when print drops break off from the jets and the non-print drop voltage state is active when non-print drops or large non-print drops break off from the jets in all the nozzles in different groups. This produces a print drop charge state on print drops and non-print drop charge states on non-print drops. Step 170 is followed by step 175.

In step 175, print and non-print drops are differentially deflected. An electrostatic deflection device is used to cause print drops to travel along a path distinct from paths of the non-print drops to travel along a second path. The deflection device may include the charge electrode, bias electrodes, catchers and other components. Step 175 is followed by step 180.

In step 180, non-print drops are intercepted by a catcher for recycling and print drops are not intercepted by the catcher and allowed to contact the recording medium and are printed.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz. The specific selection of these drop size, drop speed, nozzle size and drop generation frequency parameters is dependent on the printing application.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

The invention has been described in detail with particular reference to certain example embodiments thereof, but it will be understood that variations and modifications can be effected within the scope of the invention.

PARTS LIST

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
24 Liquid Chamber
26 Non-Print Drop Catcher Contact Location
27 Large Drop Catcher Contact Location

28 Group 1 Break Off Timing Indicator
29 Group 2 Break Off Timing Indicator
30 Catcher Ledge
31 Drop Merge Location
32 Break off Location
33 Large Drop Break off location
34 Drop Pair
35 Print Drop
36 Non-Print Drop
37 Print Drop Path
38 Non-Print Drop Path
39 Large Non-Print Drop Path
40 Continuous Liquid Ejection System
41 Group Time Delay
42 Drop Formation Device Transducer
43 Liquid Jet
44 Charge electrode
44*a* Second Charge Electrode
45 Charge Electrode
45*a* Second Charge Electrode
46 Printed Ink Drop
47 Catcher
48 Ink Film
49 Large Drop
50 Nozzle
51 Charging Voltage Source
52 Catcher Face
53 Deflection Electrode
54 Third Alternate Path
55 Stimulation Waveform
56 Stimulation Waveform Source
57 Catcher Bottom Plate
58 Ink Recovery Channel
59 Stimulation Transducer
60 Stimulation Device
61 Air Plenum
52 Insulating Adhesive
62*a* Second Insulating Adhesive
63 Deflection Electrode
64 Insulating Adhesive
64*a* Second Insulating Adhesive
65 Arrow indicating air flow direction
66 Gap
67 Catcher
68 Insulator
68*a* Insulator
69 Insulator
70 Grounded Conductor
71 Insulator
72 Insulator
73 Insulator
74 Deflection Electrode
75 Grounded Conductor
76 First Group trigger
77 Second Group trigger
78 Group Timing Delay Device
81 Print Drop Time Lapse Sequence Indicator
82 Non-Print Drop Time Lapse Sequence Indicator
83 Charging Device
84 Large Non-Print Drop Time Lapse Sequence Indicator
87 Liquid Jet Central Axis
88 Print drop charge measurement device
91 First drop forming pulse
92 Second drop forming pulse
93 Phase Delay Time
94 Large Drop Forming Pulse
95 Non-Print Drop Voltage State
96 Print Drop Voltage State
97 Charge Electrode Waveform
98 Print Drop Forming Pulse
99 Non-print Drop Forming Pulse
102 Second Pulse of Print Drop Forming Waveform
103 Third Pulse of Print Drop Forming Waveform
150 Provide pressurized liquid through nozzle step
155 Modulate liquid jet using drop formation device step
160 Provide charging device step
165 Synchronize charging device and drop formation device step
170 Deflects drops step
175 Intercept selected drops step

The invention claimed is:

1. A method of printing comprising;

providing liquid under pressure sufficient to eject liquid jets through a plurality of nozzles of a liquid chamber, the plurality of nozzles being disposed along a nozzle array direction, the plurality of nozzles being arranged into a first group and second group in which the nozzles of the first group and second group are interleaved such that a nozzle of the first group is positioned between adjacent nozzles of the second group and a nozzle of the second group is positioned between adjacent nozzles of the first group;

providing a drop formation device associated with each of the plurality of nozzles;

providing input image data;

providing each of the drop formation devices with a sequence of drop formation waveforms to modulate the liquid jets to selectively cause portions of the liquid jets to break off into streams of one or more print drops and one or more non-print drops in response to the input image data;

providing a group timing delay device to shift the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction;

providing a charging device including:

a common charge electrode associated with the liquid jets formed from both the nozzles of the first group and the nozzles of the second group; and a source of varying electrical potential between the charge electrode and the liquid jet, the source of varying electrical potential providing a charging waveform, the charging waveform being independent of the print and non-print drop pattern;

synchronizing the charging device with the drop formation device and the group timing delay device to produce a print drop charge state on the print drops and to produce a non-print drop charge state on the non-print drops which is substantially different from the print drop charge state;

providing a deflection device;

causing drops having the print drop charge state and the non-print drop charge state to travel along different paths using the deflection device;

providing a catcher; and intercepting non-print drops using the catcher while allowing print drops to continue to travel along a path toward a receiver.

2. The method of claim 1, the plurality of nozzles also being arranged in a third nozzle group, nozzles of the third group being interleaved with nozzles of the first group and nozzles of the second group, wherein providing the group timing delay device includes providing a group timing delay device that is configured to shift the timing of the drop formation waveforms of the third group relative to the first group and the second group.

3. The method of claim 1, wherein the liquid jets to break off into streams of one or more print drops and one or more non-print drops separated on average by the drop period.

4. The method of claim 3, wherein the source of varying electrical potential between the charge electrode and the liquid jet produces a waveform having a first distinct voltage state and a second distinct voltage state, the waveform having a period equal to the drop period.

5. The method of claim 4, wherein the print drop voltage state and non-print drop voltage states are selected to have substantially lower charge on print drops when compared to the charge on non-print drops independent of input image data.

6. The method of claim 5, wherein the print drops are uncharged.

7. The method of claim 3, wherein the timing shift between the first group of nozzles and the second group of nozzles is between 0.1 and 0.4 drop periods.

8. The method of claim 3, wherein the charge to mass ratios of all the non-print drops are the same when compared to each other.

9. The method of claim 3, wherein every print drop produced by a single jet is preceded and followed by a non-print drop.

10. The method of claim 9, wherein the timing shift between the first group of nozzles and the second group of nozzles is equal to the drop period.

11. The method of claim 1, wherein the drop formation device comprises a drop formation transducer associated with each of the nozzles, wherein the drop formation transducer is one of a thermal device, a piezoelectric device, a MEMS actuator, an electrohydrodynamic device, an optical device, an electrostrictive device, and combinations thereof.

12. The method of claim 1, wherein the charge electrode is placed adjacent to the break off location of the liquid jets.

13. The method of claim 1, wherein the deflection device further comprises a deflection electrode in electrical communication with a source of electrical potential that creates a drop deflection field to deflect charged drops.

14. The method of claim 1, wherein the plurality of nozzles, the drop formation devices and the timing devices are formed on a single MEMS CMOS chip.

15. The method of claim 1, the print drops having impacted a receiver that moves at a speed relative to the nozzle array, wherein the timing shift between the first nozzle group and the second nozzle group is dependent on the speed of the receiver relative to the nozzle array and results in a fixed shift between locations of printed drops created by the first nozzle group and the second nozzle group when viewed along a direction of receiver travel independent of receiver speed.

16. The method of claim 1, wherein the group timing delay device is inherent to the drop formation waveforms supplied to the drop formation devices of nozzles of one of the first group or the second group so that the print drops formed from nozzles of the first group and the print drops formed from nozzles of the second group are not aligned relative to each other along the nozzle array direction.

17. The method of claim 1, wherein the group timing delay is achieved by shifting the input image data supplied to drop formation devices associated with first and second nozzle groups to shift the timing of the drop formation waveforms supplied to the drop formation devices of nozzles of one of the first group or the second group so that the print drops formed from nozzles of the first group and the print drops formed from nozzles of the second group are not aligned relative to each other along the nozzle array direction.

18. The method of claim 1, wherein providing a charging device synchronized with the drop formation device and the group timing delay device to produce a print drop charge state on the print drops and to produce a non-print drop charge state on the non-print drops which is substantially different from the print drop charge state further comprises producing a print drop charge state on the print drops which is of opposite polarity compared to non-print drop charge state on the non-print drops.

19. The method of claim 1, further comprising:

providing a charge measurement device to measure the average charge on print drops; and adjusting the voltage level of the print drop voltage state of the charging waveform based on the charge measurement using a feedback loop.

* * * * *

UNITED STATES PATENT AND TRADEMARK OFFICE

CERTIFICATE OF CORRECTION

PATENT NO. : 8,651,633 B2
APPLICATION NO. : 13/424422
DATED : February 18, 2014
INVENTOR(S) : Michael A. Marcus et al.

It is certified that error appears in the above-identified patent and that said Letters Patent is hereby corrected as shown below:

In the Drawings:

| **Issued Patent** | **Description of Error** |
|---|---|
| FIG. 10B | Delete "(Prior Art)" |
| FIG. 11B | Delete "(Prior Art)" |
| FIG. 12B | Delete "(Prior Art)" |
| FIG. 13B | Delete "(Prior Art)" |
| FIG. 15B | Delete "(Prior Art)" |
| FIG. 17B | Delete "(Prior Art)" |

Signed and Sealed this
Thirtieth Day of September, 2014

Michelle K. Lee

Michelle K. Lee
*Deputy Director of the United States Patent and Trademark Office*